US008517782B2

(12) United States Patent
Ota

(10) Patent No.: US 8,517,782 B2
(45) Date of Patent: Aug. 27, 2013

(54) MARINE VESSEL PROPULSION DEVICE AND MARINE VESSEL INCLUDING THE SAME

(75) Inventor: Nobuharu Ota, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 210 days.

(21) Appl. No.: 12/957,519

(22) Filed: Dec. 1, 2010

(65) Prior Publication Data

US 2012/0021659 A1 Jan. 26, 2012

(30) Foreign Application Priority Data

Jul. 22, 2010 (JP) ..... 2010-165094

(51) Int. Cl.
*B63H 11/11* (2006.01)
*B60L 15/00* (2006.01)

(52) U.S. Cl.
USPC ..... 440/41; 701/21

(58) Field of Classification Search
USPC ..... 440/38, 40, 41, 74, 87; 701/21
See application file for complete search history.

(56) References Cited

U.S. PATENT DOCUMENTS

| | | | | |
|---|---|---|---|---|
| 3,918,256 | A * | 11/1975 | Ashleman | 60/221 |
| 5,755,601 | A | 5/1998 | Jones | |
| 6,050,866 | A | 4/2000 | Bass | |
| 7,247,066 | B2 * | 7/2007 | Harada et al. | 440/84 |
| 7,775,844 | B2 * | 8/2010 | St-Pierre et al. | 440/42 |
| 7,892,053 | B2 * | 2/2011 | St-Pierre et al. | 440/40 |
| 8,126,602 | B2 * | 2/2012 | Morvillo | 701/21 |

FOREIGN PATENT DOCUMENTS

| | | | |
|---|---|---|---|
| JP | 1-276321 | A | 11/1989 |
| JP | 6-156379 | A | 6/1994 |

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A marine vessel propulsion device includes an engine, a jet propulsion unit, and a reverse gate. The jet propulsion unit includes a jet port arranged to jet water toward a rear of a hull. The reverse gate is arranged to be capable of being changed in opening degree between a fully closed position of covering an entirety of the jet port and a fully opened position of not covering the jet port at all. The reverse gate is arranged to be moved, between the fully closed position and the fully opened position, to a first partially closed position of only partially covering the jet port and a second partially closed position of only partially covering the jet port and being closer to the fully opened position than the first partially closed position.

6 Claims, 23 Drawing Sheets

MARINE VESSEL PROPULSION DEVICE AND MARINE VESSEL INCLUDING THE SAME

BACKGROUND OF THE INVENTION

1. Field of the Invention

The present invention relates to a marine vessel propulsion device including a jet propulsion unit that jets water to generate a propulsive force and to a marine vessel including such a marine vessel propulsion device.

2. Description of Related Art

A conventional marine vessel that includes a jet propulsion unit is disclosed in U.S. Pat. No. 5,755,601. The marine vessel includes a hull, a steering assembly, an engine, a jet pump (jet propulsion unit), a thrust guide, and a reverse gate. The jet pump has a nozzle that jets water toward a rear of the hull. The thrust guide is attached to the reverse gate so as to be pivotable to the right and left. The thrust guide is arranged to orient a direction of the water jetted from the nozzle. When the steering assembly is operated by a marine vessel operator, the thrust guide pivots to the right and left in linkage with the operation.

The reverse gate is attached in a vertically pivotable manner to flanges that are fixed to the nozzle. The reverse gate is arranged to be pivotable between a forward position (full-up position) and a reverse position (full-down position). The reverse position is located at a rear of the thrust guide and is a fully closed position at which the reverse gate covers an entirety of an opening of the thrust guide. When positioned at the reverse position, the reverse gate covers the entirety of the opening of the thrust guide and reverses the water, jetted from the nozzle and through the thrust guide, to a forward direction. A propulsive force in a reverse direction is thereby applied to the hull. The forward position is located above the reverse position and is a fully opened position at which the reverse gate does not cover the opening of the thrust guide at all. When positioned at the forward position, the reverse gate does not block the water jetted from the jet nozzle and thus a propulsive force in the forward direction is applied to the hull. The reverse gate can be positioned at a neutral position between the forward position and the reverse position. At the neutral position, the forward direction propulsive force and the reverse direction propulsive force are substantially balanced and the hull can thus be maintained in position.

A right lever for throttle control and a left lever for deceleration control are attached to the steering assembly. When the right lever is operated without operating the left lever, the reverse gate is positioned at the forward position. When the left lever is operated without operating the right lever, the reverse gate is positioned at the reverse position. When both the right and left levers are operated, the reverse gate is positioned at the neutral position. A throttle opening degree of the engine is mechanically linked to the lever operations by throttle cables coupled to the right and left levers.

SUMMARY OF THE INVENTION

In U.S. Pat. No. 5,755,601, there is a description concerning the positioning of the reverse gate at a partially closed position between the neutral position and the fully closed position. Although not clearly described in the '601 patent, it is considered that when the reverse gate is positioned at the partially closed position, the hull can be moved at a low speed. However, it is considered that in this case, the hull cannot be driven forward because the reverse direction propulsive force surpasses the forward direction propulsive force. Thus, an object of driving the hull forward at low speed is not achieved. Moreover, to steer the hull in this state, the marine vessel operator must operate the right lever and the left lever at the same time and also operate the steering assembly to the right and left. That is, the marine vessel operator must perform operations related to the three elements of throttle opening degree, reverse gate position, and steering angle at the same time, and the operation is thus complicated.

A preferred embodiment according to a first aspect of the present invention provides a marine vessel propulsion device that includes an engine including a throttle valve that is arranged to open and close an air intake passage, a jet propulsion unit driven by the engine, and a reverse gate. The jet propulsion unit includes a jet port that is arranged to jet water to a rear of a hull, and to be capable of changing a direction of the water, jetted from the jet port, to the right and left. The reverse gate is arranged to be capable of being changed in opening degree between a fully closed position of covering an entirety of the jet port when the jet port is viewed from a jetting direction of the jet propulsion unit and a fully opened position of not covering the jet port at all. The reverse gate is arranged so that at the fully closed position, it guides the water, jetted from the jet port, toward a front of the hull. Further, the reverse gate is arranged to be moved, between the fully closed position and the fully opened position, to a first partially closed position of only partially covering the jet port and a second partially closed position of only partially covering the jet port and being closer to the fully opened position than the first partially closed position. The marine vessel propulsion device further includes a steering device, such as a steering wheel, arranged to be operated by an operator to change the direction of the water, jetted by the jet propulsion unit, to the right and left, and a lever arranged to be operated by the operator to set an opening degree of the throttle valve of the engine and the opening degree of the reverse gate. The lever is arranged to be moved, between a maximum output forward drive position and a maximum output reverse drive position, to a gate fully opened position, a forward drive starting position, a neutral position, and a reverse drive starting position set in that order from the maximum output forward drive position toward the maximum output reverse drive position. The marine vessel propulsion device further includes a lever position keeping unit arranged to keep the lever at the forward drive starting position, the neutral position, and the reverse drive starting position, respectively, a throttle opening degree operating device connected to the lever and arranged to operate the opening degree of the throttle valve in linkage with the operation of the lever, and a gate position operating device connected to the lever and arranged to operate the position of the reverse gate in linkage with the operation of the lever. The throttle opening degree operating device is arranged to increase the opening degree of the throttle valve in conformance to an operation amount of the lever from the gate fully opened position when the lever is between the gate fully opened position and the maximum output forward drive position, increase the opening degree of the throttle valve in conformance to the operation amount of the lever from the reverse drive starting position when the lever is between the reverse drive starting position and the maximum output reverse drive position, and fix the opening degree of the throttle valve at a predetermined first opening degree when the lever is between the reverse drive starting position and the gate fully opened position. The gate position operating device is arranged to position the reverse gate at the fully opened position when the lever is between the gate fully opened position and the maximum output forward drive position, position the reverse gate at the fully closed position when the lever is between the reverse drive starting position and the maximum output reverse drive position, continuously displace the reverse gate from the fully closed position to the first partially closed position in conformance to the operation amount of the lever from the reverse drive starting position when the lever is between the reverse drive starting position and the neutral position, continuously displace the reverse gate from the first partially closed position to the second partially closed position in conformance to the operation amount of the lever from the neutral position when the lever is between the neutral position and the forward drive starting position, and continuously displace the reverse gate from the second partially closed position to the fully opened position in conformance to the operation amount of the lever from the forward drive starting position when the lever is between the forward drive starting position and the gate fully opened position.

When the reverse gate is at the fully opened position, the water jetted from the jet port is mainly directed to the rear of the hull. A propulsive force in a forward drive direction is thus applied to the hull. When the reverse gate is at the fully closed position, a large portion of the water jetted from the jet port is reversed by the reverse gate and is directed to the front of the hull. A propulsive force in a reverse drive direction is thus applied to the hull. When the reverse gate is at the first partially closed position or the second partially closed position, a portion of the water jetted from the jet port is directed to the rear of the hull and another portion is directed to the front of the hull. Propulsive forces in the forward drive direction and the reverse drive direction are thus applied to the hull. The second partially closed position is closer to the fully opened position than the first partially closed position. Thus, when the reverse gate is at the second partially closed position, the propulsive force in the forward drive direction is greater than when the reverse gate is at the first partially closed position.

During high-speed travel, the jet propulsion unit jets a water stream at a high speed. Thus, when the direction of the water stream is changed to the right or left in accordance with the operation of the steering wheel, the hull turns readily. On the other hand, during low-speed travel, the water stream jetted by the jet propulsion unit is low in speed. A large steering force thus cannot be obtained even when the direction of the water stream is changed to the right or left. Influence of inertia of the hull during turning is thus large.

With a personal watercraft, which is an example of the marine vessel equipped with a jet propulsion unit (water jet propulsion watercraft), hull behavior due to inertia can be suppressed comparatively readily because the hull is small. However, with a jet boat, which is another example of a water jet propulsion watercraft, the hull is comparatively large. The inertia of the hull thus has a large influence on the steering of the hull during low-speed travel.

A case where a hull, which is turning due to inertia, is to be made to travel straight shall now be considered. In this case, even when the steering wheel is operated to turn the hull, if the water stream is low in speed, a long time is required until the turning of the hull due to inertia is canceled. The hull behavior that is in accordance with the steering wheel operation begins after the turning due to inertia has been canceled. At the same time, the hull starts turning due to inertia toward the direction of operation of the steering wheel. The marine vessel operator operates the steering wheel in the opposite direction to stop this turning due to inertia. A skilled marine vessel operator starts the operations of the steering wheel in the opposite direction at appropriate timings before and after the turning of the hull due to inertia stops. The hull can thereby be made to travel straight. Marine vessel maneuvering of the jet boat during low-speed travel thus boils down to control of hull turning dominated by inertia and is thus not necessarily easy.

The present inventor discovered that when the reverse gate is positioned at the second partially closed position as described above, excellent marine vessel maneuvering performance can be obtained even during low-speed travel. That is, when the reverse gate is at the second partially closed position, the hull can be driven forward while applying an appropriate braking force to the hull via the propulsive force in the reverse drive direction. Turning of the hull due to inertia can thereby be canceled out immediately. Thus, when the water jetting direction is changed to the right or the left by operation of the steering wheel, the hull behavior that is in accordance with the operation is achieved immediately. That is, the response with respect to the steering wheel operation is improved and an excellent maneuvering performance can be obtained.

As another solution to realizing excellent maneuvering performance during low-speed travel in a marine vessel with a large inertial mass, such as a jet boat, the providing of a skeg may be considered. However, a large skeg is required to obtain an adequate effect and this gives rise to a large resistance against gliding when the hull glides on a water surface at high speed. That is, energy efficiency during high-speed travel is sacrificed. The providing of a rudder at a rear of the jet propulsion unit may be considered as yet another solution. However, when a rudder is provided at a stern, boarding and exiting from the stern (access to the hull from inside water and access into water from the hull) are disabled and convenience is compromised. Also, in a water jet propulsion watercraft, a skeg or a rudder is a protrusion protruding from a hull bottom and thus various adverse affects are expected. The water jet propulsion watercraft does not have an exposed propeller disposed at the stern and boarding and exiting from the stern are easy, which is one of its major points of appeal. Thus, if boarding and exiting from the stern are restricted, the convenience and commercial value of the water jet propulsion watercraft are reduced.

The present preferred embodiment of the present invention does not cause or experience such adverse affects, and by positioning the reverse gate at the second partially closed position, excellent maneuvering performance (steering response) during low-speed travel is realized without sacrificing high-speed gliding performance and convenience.

Further, with the present preferred embodiment, the position of the lever arranged to set the opening degree of the throttle valve and the opening degree of the reverse gate is kept at the forward drive starting position, the neutral position, and the reverse drive starting position, respectively, by the lever position keeping unit. The marine vessel operator can thus operate the steering wheel while the lever is kept at any of the above positions by the lever position keeping unit. That is, there is no need to operate the lever and the steering wheel at the same time.

The gate position operating device positions the reverse gate at the second partially closed position when the lever is positioned at the forward drive starting position. In this state, the throttle opening degree operating device sets the opening degree of the throttle valve at the first opening degree. At the second partially closed position, a propulsive force in the forward drive direction can be applied to the hull at the same time as applying the braking force (propulsive force in the reverse drive direction) to cancel out the inertial force to the hull. Excellent response with respect to the steering wheel operation can thereby be obtained while making the hull travel forward at low speed, and an excellent maneuvering performance can thus be realized. Moreover, the lever is kept at the forward drive starting position by the lever position keeping unit and the marine vessel operator can thus concentrate on the operation of the steering wheel. Marine vessel maneuvering thus does not become complicated.

A preferred embodiment according to a second aspect of the present invention provides a marine vessel propulsion device that includes an engine including a throttle valve that is arranged to open and close an air intake passage, a jet propulsion unit driven by the engine, and a reverse gate. The jet propulsion unit includes a jet port that is arranged to jet water to a rear of a hull, and to be capable of changing a direction of the water, jetted from the jet port, to the right and left. The reverse gate is arranged to be capable of being changed in opening degree between a fully closed position of covering an entirety of the jet port when the jet port is viewed from a jetting direction of the jet propulsion unit and a fully opened position of not covering the jet port at all. Further, the reverse gate is arranged so that at the fully closed position, it guides the water, jetted from the jet port, toward a front of the hull. The marine vessel propulsion device further includes a steering device, such as a steering wheel, arranged to be operated by an operator to change the direction of the water, jetted by the jet propulsion unit, to the right and left, and a lever arranged to be operated by the operator to set an opening degree of the throttle valve of the engine and the opening degree of the reverse gate. The lever is arranged to be moved, between a maximum output forward drive position and a maximum output reverse drive position, to a gate fully opened position, a forward drive starting position, a neutral position, and a reverse drive starting position set in that order from the maximum output forward drive position toward the maximum output reverse drive position. The marine vessel propulsion device further includes a lever position keeping unit arranged to keep the lever at the forward drive starting position, the neutral position, and the reverse drive starting position, respectively, and a throttle opening degree operating unit. The throttle opening degree operating unit is arranged to increase the opening degree of the throttle valve in conformance to an operation amount of the lever from the gate fully opened position when the lever is between the gate fully opened position and the maximum output forward drive position, increase the opening degree of the throttle valve in conformance to the operation amount of the lever from the reverse drive starting position when the lever is between the reverse drive starting position and the maximum output reverse drive position, fix the opening degree of the throttle valve at a predetermined first opening degree when the lever is between the reverse drive starting position and the forward drive starting position, and set the opening degree of the throttle valve to no less than the first opening degree when the lever is between the forward drive starting position and the gate fully opened position. The marine vessel propulsion device also includes a reverse gate keeping unit. The reverse gate keeping unit is arranged to keep the reverse gate at the fully opened position when the lever is positioned in a range from the gate fully opened position to the maximum output forward drive position, keep the reverse gate at the fully closed position when the lever is positioned in a range from the reverse drive starting position to the maximum output reverse drive position, keep the reverse gate at a first partially closed position of only partially covering the jet port when the lever is positioned at the neutral position, and keep the reverse gate at a second partially closed position of only partially covering the jet port and being closer to the fully opened position than the first partially closed position when the lever is positioned at the forward drive starting position.

With this arrangement, when the lever position is kept at the forward drive starting position, the reverse gate is kept at the second partially closed position. Excellent response can thereby be obtained with respect to the steering wheel operation and marine vessel maneuvering is also made easy during low-speed travel.

In the marine vessel propulsion device according to the present preferred embodiment of the second aspect of the present invention, the throttle opening degree operating unit may be arranged to control the throttle valve to be set at the first opening degree when the lever is positioned in a range from the forward drive starting position to the gate fully opened position.

Also, in the marine vessel propulsion device according to the present preferred embodiment of the second aspect of the present invention, the throttle opening degree operating unit may be arranged to keep the throttle valve at a predetermined second opening degree, which is greater than the first opening degree, when the lever is positioned in the range from the forward drive starting position to the gate fully opened position. In this case, an engine output can be made large at the forward drive starting position to enable a propulsive force in the forward drive direction to be obtained readily. Even better maneuvering performance can thereby be realized during low-speed travel.

In the marine vessel propulsion device according to the present preferred embodiment of the second aspect of the present invention, the throttle opening degree operating unit preferably includes a first opening degree changing unit that enables changing of the first opening degree by the operator. The output when low-speed forward travel is performed with the lever being set at the forward drive starting position, etc., can thereby be adjusted.

In the marine vessel propulsion device according to the present preferred embodiment of the second aspect of the present invention, the marine vessel propulsion device may further include a lever position detecting unit arranged to detect the position of the lever, and an actuator arranged to actuate the reverse gate. Preferably in this case, the reverse gate keeping unit includes an actuator control unit arranged to control the actuator in accordance with the lever position detected by the lever position detecting unit.

A preferred embodiment of the present invention provides a marine vessel including a hull, and a marine vessel propulsion device installed on the hull and including the features and characteristics described above.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
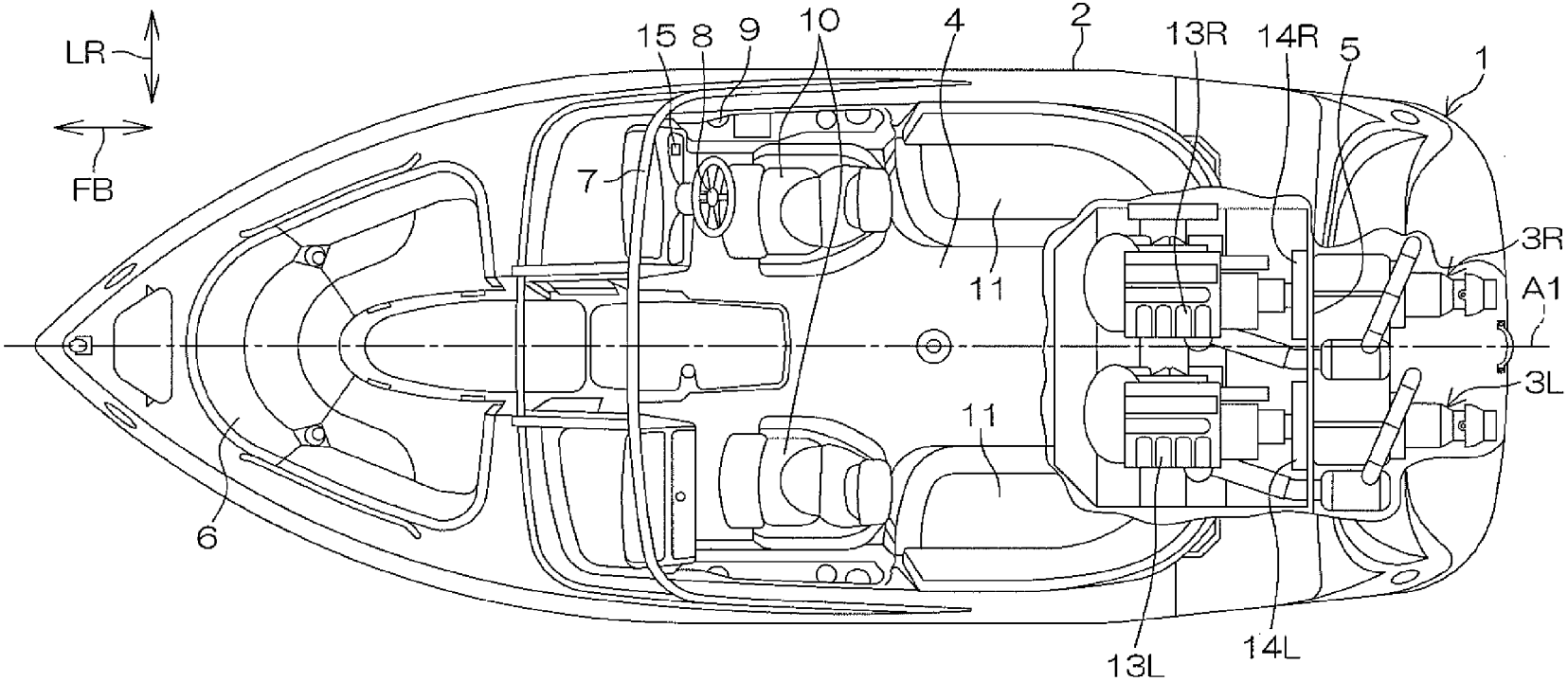
FIG. 1 is a plan view of a general arrangement of a water jet propulsion watercraft according to a preferred embodiment of the present invention.
Figure 2:
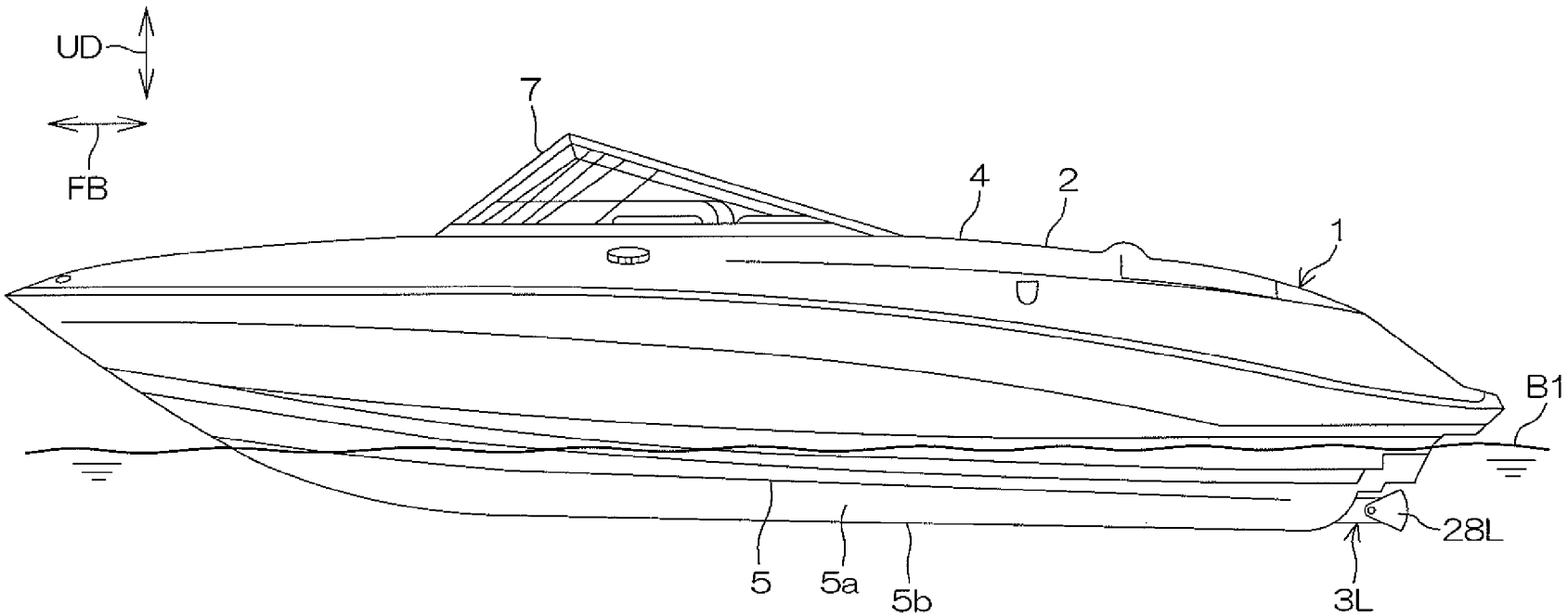
FIG. 2 is a left side view of the water jet propulsion watercraft.

FIG. 1 is a plan view of a general arrangement of a water jet propulsion watercraft 1 (example of a marine vessel) according to a preferred embodiment of the present invention. A portion of a hull is broken away to show a portion of an arrangement of an interior of the hull. FIG. 2 is a left side view of the water jet propulsion watercraft 1 and shows a stationary state of floating on water.

The water jet propulsion watercraft 1 is a marine vessel used for traveling on water, for example, a lake, ocean, etc. The water jet propulsion watercraft 1 according to the present preferred embodiment is a marine vessel of a type called a jet boat or a sport boat and has a comparatively large hull 2. The water jet propulsion watercraft 1 includes the hull 2, and a pair of right and left jet propulsion machines 3R and 3L that are attached to the hull 2 and disposed at right and left sides across a hull center line A1. The hull center line A1 is a straight line passing through a stem and a stern center in plan view.

The hull 2 extends elongatedly in a front/rear direction FB and has a predetermined width in a right/left direction LR. In the following description, the front/rear direction FB of the hull 2 shall be referred to simply as the "front/rear direction FB." Also, the right/left direction LR of the hull 2 shall be referred to simply as the "right/left direction LR." An up/down direction of the hull 2 when the water jet propulsion watercraft 1 is stationary in a normal orientation on the water shall be referred to simply as the "up/down direction UD." Further, when simply "right and left," "front and rear," or "up and down" is mentioned, these terms shall refer to the right/left direction, the front/rear direction, or the up/down direction of the hull 2, respectively.

The hull 2 includes a deck 4 and a hull body 5. The hull body 5 is disposed below the deck 4. A ridgeline or keel 5*b* extending to the front and rear is provided on a bottom surface 5*a* (hull bottom) of the hull body 5. The hull body 5 has a shape that is substantially right/left symmetrical with the ridgeline 5*b* as a symmetry axis. In plan view, the ridgeline 5*b* coincides with the hull center line A1.

A floor surface of the deck 4 is substantially parallel to the front/rear direction FB and the right/left direction LR. On the deck 4, a front seat 6, a pair of right and left central seats 10, and a rear seat 11 are disposed in the order from the front to the rear. A windshield 7 is disposed between the front seat 6 and the central seat 10. One of the pair of central seats 10 is a seat (marine vessel operator seat) for a marine vessel operator. A steering wheel 8 is disposed in front of the marine vessel operator seat. A remote control unit 9 is disposed at a side of the marine vessel operator seat. Further, an output changing operation unit 15, arranged to be operated by the marine vessel operator to change an output during low-speed forward travel, is provided in a vicinity of the marine vessel operator seat. The output changing operation unit 15 may instead be provided in a vicinity of the steering wheel 8 or the remote control unit 9.

The steering wheel 8 is an operating member arranged to be operated by the marine vessel operator to change a direction of the hull 2. By operation of the steering wheel 8, a direction in which the pair of right and left jet propulsion machines 3R and 3L jet water can be changed to the right or left.

The remote control unit 9 is another operating member arranged to be operated by the marine vessel operator. By operating the remote control unit 9, the marine vessel operator can adjust outputs of engines 13R and 13L that provide driving forces to the pair of right and left jet propulsion machines 3R and 3L and switch a heading direction of the hull 2 between forward drive and reverse drive. That is, the remote control unit 9 has functions of both an operating member for switching between forward drive and reverse drive and an accelerator operating member for engine output adjustment.

The output changing operation unit 15 is yet another operating member arranged to be operated by the marine vessel operator. By operating the output changing operation unit 15, the marine vessel operator can change throttle opening degrees (idling opening degrees; fully closed opening degrees) of the engines 13R and 13L during idling. The output changing operation unit 15 is an example of a first opening degree changing unit arranged to be operated by the operator to change the idling opening degrees as first opening degrees.

To the hull body 5 are attached the pair of right and left engines 13R and 13L, a pair of right and left engine ECUs (electronic control units) 14R and 14L, and the pair of right and left jet propulsion machines 3R and 3L.

The pair of right and left engines 13R and 13L are attached at positions inside the hull body 5 that are close to the stern and are disposed at right and left sides across the hull center line A1 in plan view. Each of the engines 13R and 13L is, for example, a multi-cylinder, 4-cycle internal combustion engine. The left engine 13L is a drive source that provides a driving force to the left jet propulsion machine 3L. The right engine 13R is a drive source that provides a driving force to the right jet propulsion machine 3R. By obtaining the driving forces from the engines 13R and 13L, the jet propulsion machines 3R and 3L suck in water from the hull bottom and jet the water. A propulsive force is thereby applied to the hull 2. The left engine ECU 14L controls the left engine 13L. The right engine ECU 14R controls the right engine 13R.

Figure 3:
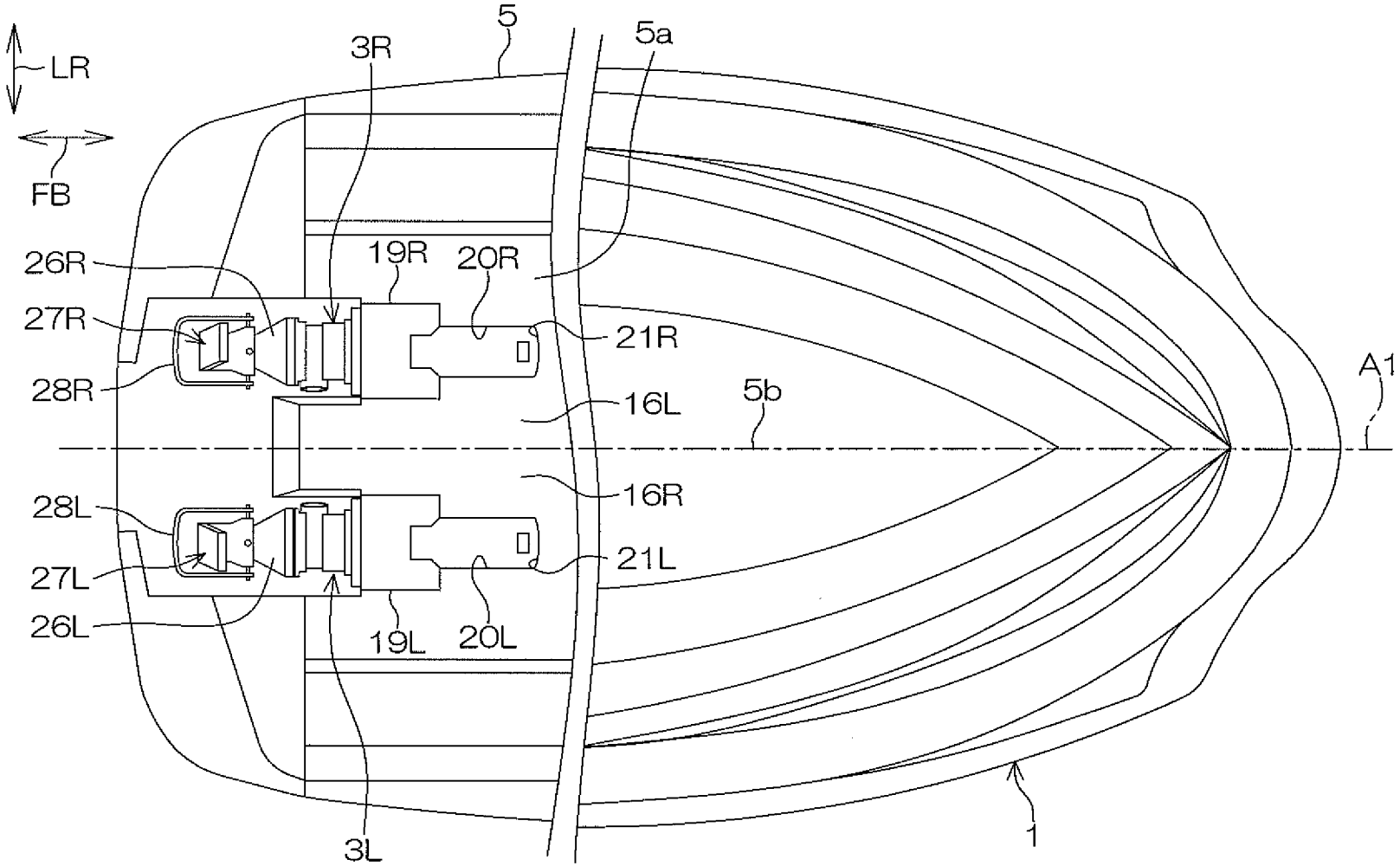
FIG. 3 is a bottom view of the water jet propulsion watercraft.
Figure 4:
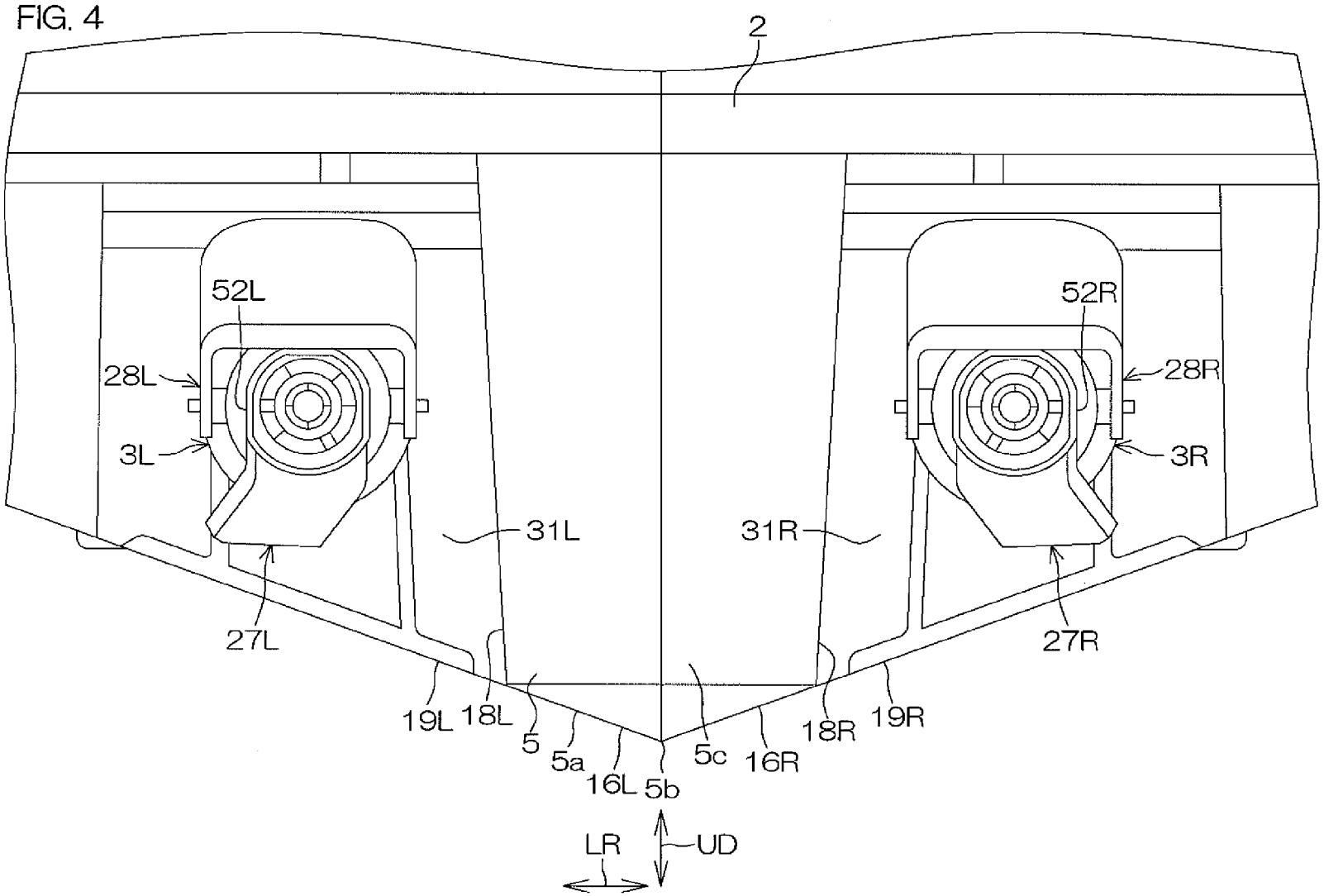
FIG. 4 is a partial rear view of a vicinity of right and left jet propulsion machines provided in the water jet propulsion watercraft as viewed from a rear of a hull.
Figure 5:
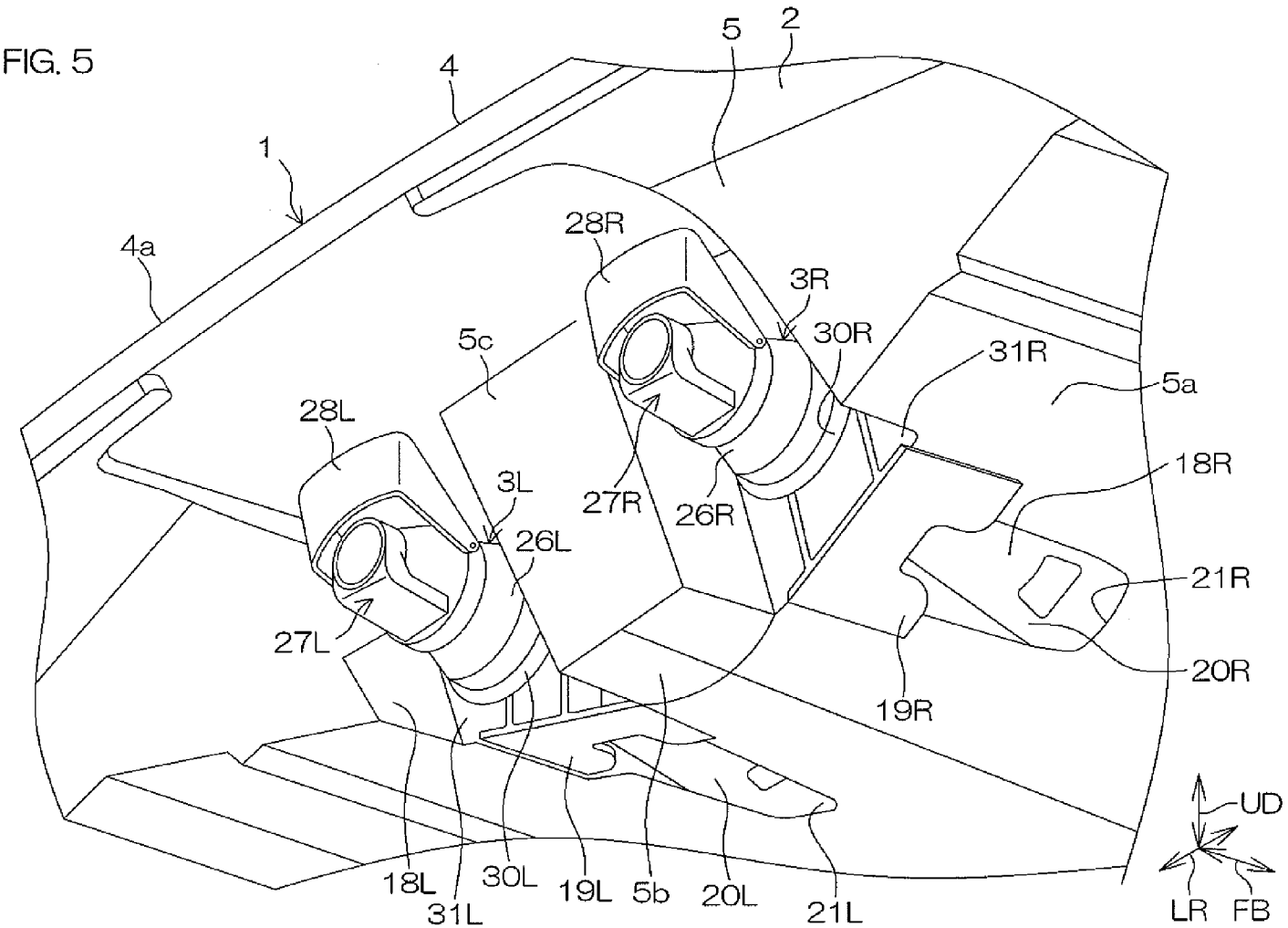
FIG. 5 is a perspective view of a rear portion of the water jet propulsion watercraft as viewed from below the hull.

FIG. 3 is a bottom view of the water jet propulsion watercraft 1. FIG. 4 is a partial rear view of a vicinity of the right and left jet propulsion machines 3R and 3L as viewed from the rear of the hull 2. Further, FIG. 5 is a perspective view of a rear portion of the water jet propulsion watercraft 1 as viewed from below the hull 2.

A pair of right and left inclined surfaces 16R and 16L are arranged in a right/left symmetrical manner at a rear end side of a bottom surface 5*a* of the hull body 5. The left inclining surface 16L inclines toward an upper left from the ridgeline 5*b*. The right inclining surface 16R inclines toward an upper right from the ridgeline 5*b*. The bottom surface 5*a* of the hull 2 thus defines a V-shaped hull bottom that gradually becomes high toward the sides from the center (ridgeline 5*b*).

The left jet propulsion machine 3L is disposed at the upper left relative to the ridgeline 5*b*, and the right jet propulsion machine 3R is disposed at the upper right relative to the ridgeline 5*b*.

Above a rear end of the hull body 5, a rear portion 4*a* of the deck 4 protrudes to the rear. At a rear end of a bottom portion of the hull body 5, right and left recessed portions 18R and 18L are arranged in a right/left symmetrical manner. The right and left recessed portions 18R and 18L are arranged to respectively house a portion of the right jet propulsion machine 3R and a portion of the left jet propulsion machine 3L.

The left recessed portion 18L is arranged at the left side of the ridgeline 5*b*. The left recessed portion 18L extends to the front and rear, is arranged to extend from a rear end portion of the bottom surface 5*a* of the hull body 5 to a rear surface 5*c* of the hull body 5, and is opened to the rear at the rear surface 5*c*. A roof surface of the left recessed portion 18L is arranged to define an inclined surface that becomes higher toward the rear. In a similar manner, the right recessed portion 18R is arranged at the right side of the ridgeline 5*b*. The right recessed portion 18R extends to the front and rear, is arranged to extend from the rear end portion of the bottom surface 5*a* of the hull body 5 to the rear surface 5*c* of the hull body 5, and is opened to the rear at the rear surface 5*c*. A roof surface of the right recessed portion 18R is arranged to define an inclined surface that becomes higher toward the rear.

Figures 6, 6A, 6B:
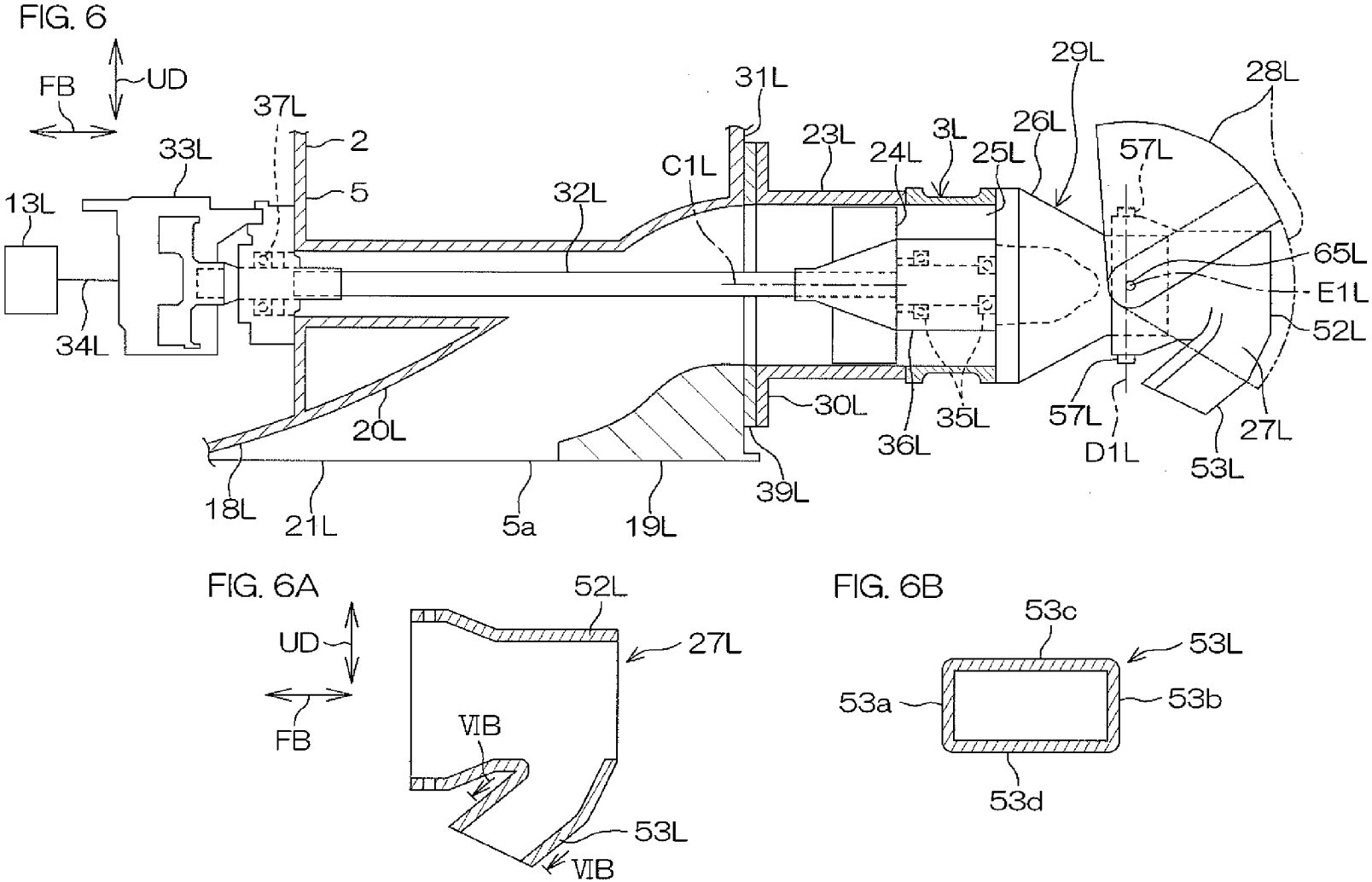
FIG. 6 is a longitudinal sectional view of an arrangement of the left jet propulsion machine and shows a section as viewed from a left side.
FIG. 6A is a longitudinal sectional view of a deflector provided in the left jet propulsion machine.
FIG. 6B is a sectional view taken along line VIB-VIB in FIG. 6A.

FIG. 6 is a longitudinal sectional view of an arrangement of the left jet propulsion machine 3L and shows the section as viewed from the left side. A plate member 19L is attached from below to a rear end portion of the recessed portion 18L. The plate member 19L closes the rear end portion of the recessed portion 18L from below. An intake duct 20L is defined by the recessed portion 18L and the plate member 19L.

The front end of the intake duct 20L defines an intake 21L that opens to the bottom surface 5*a* of the hull body 5. The intake duct 20L guides water sucked in from the intake 21L to the jet nozzle 26L. The jet propulsion machine 3L is disposed to the rear of the intake 21L. The intake 21L and the jet propulsion machine 3L are aligned along the front/rear direction FB.

The jet propulsion machine 3L includes a jet unit 29L, a deflector 27L, and a reverse gate 28L. The jet unit 29L is a jet propulsion unit that is arranged to suck in water from the hull bottom of the hull 2 and jet the water to the rear of the hull 2. The jet unit 29L includes a housing 23L, an impeller 24L, a stator vane 25L, and a jet nozzle 26L. The impeller 24L and the stator vane 25L are disposed inside the housing 23L.

The housing 23L has a cylindrical shape. An annular flange 30L is provided at a front end of the housing 23L. The annular flange 30L opposes a transom surface 31L of the hull body 5 across an annular transom plate 39L. The annular flange 30L is fixed to the transom surface 31L using bolts or other fastening members (not shown). The intake duct 20L opens at the transom surface 31L. A space inside the housing 23L is in communication with a space inside the intake duct 20L.

The impeller 24L is arranged to suck in water from the intake duct 20L and deliver the water to the jet nozzle 26L. The impeller 24L includes a plurality of blades that are disposed radially about its rotation axis C1L. The impeller 24L is fixed to an intermediate portion of a driveshaft 32L.

The driveshaft 32L extends to the front and rear and is arranged to transmit the output of the engine 13L to the impeller 24L. The driveshaft 32L is disposed inside the housing 23L and the intake duct 20L.

A front end portion of the driveshaft 32L is coupled in a power transmittable manner to a crankshaft 34L of the engine 13L via a coupling 33L. A rear end portion of the driveshaft 32L passes through an inner cylinder 36L disposed inside the housing 23L. The rear end portion of the driveshaft 32L is rotatably supported by the inner cylinder 36L via a pair of bearings 35L disposed at the front and rear of the inner cylinder 36L. The front end portion of the drive shaft 32L is rotatably supported by a bearing 37L fixed to the hull body 5.

The stator vane 25L is a rectifying vane that rectifies a water flow generated by rotation of the impeller 24L. The stator vane 25L is disposed at the rear of the impeller 24L. The stator vane 25L includes a plurality of blades fixed inside the housing 23L. An outer peripheral portion of each blade is fixed to the housing 23L and an inner peripheral portion is fixed to the inner cylinder 36L.

The jet nozzle 26L is a cylindrical member through which the water stream, generated by the rotation of the impeller 24L, passes and is fixed to a rear end portion of the housing 23L. An intermediate portion in an axial direction of the jet nozzle 26L preferably has a truncated conical shape that decreases in inner diameter toward the rear. A rear end portion of the jet nozzle 26L preferably has a cylindrical shape with a substantially fixed inner diameter. By this arrangement, the jet nozzle 26L accelerates the water stream generated by the impeller 24L and jets the water stream to the rear.

The deflector 27L is disposed at the rear of the jet nozzle 26L and is arranged to change a jetting direction of the water jetted from the jet nozzle 26L. The deflector 27L preferably has a hollow shape and is arranged to jet the water, jetted from the jet nozzle 26L, to the rear or the front of the hull 2. The deflector 27L includes a forward drive jet port 52L that opens toward the rear and a reverse drive jet port 53L that opens toward the front. The forward drive jet port 52L has, for example, a cylindrical shape. As shown in the longitudinal sectional view in FIG. 6A, a water stream passage inside the forward drive jet port 52L and a water stream passage inside the reverse drive jet port 53L are connected to each other. Further, as shown in FIG. 6B (sectional view taken along line VIB-VIB in FIG. 6A), the reverse drive jet port 53L preferably has, for example, a tubular shape with a rectangular cross section. That is, the reverse drive jet port 53L includes a pair of right and left side walls 53*a* and 53*b* and a pair of connecting walls 53*c* and 53*d* that connect the side walls 53*a* and 53*b*. Inner surfaces of the side walls 53*a* and 53*b* and the connecting walls 53*c* and 53*d* are flat surfaces that are substantially parallel to the water stream direction inside the reverse drive jet port 53L.

The deflector 27L is supported by the jet nozzle 26L via bolts 57L. The bolts 57L are disposed above and below the jet nozzle 26L along a right/left pivoting axis D1L extending in the up/down direction UD. The deflector 27L is thus arranged to be pivotable to the right and left about the right/left pivoting axis D1L. The deflector 27L can thereby change the water stream direction to the right and left.

The reverse gate 28L is arranged to close the forward drive jet port 52L of the deflector 27L when the water jet propulsion watercraft 1 is to be driven in reverse. The reverse gate 28L is disposed adjacent to the deflector 27L.

More specifically, the reverse gate 28L is supported on the deflector 27L via bolts 65L. The bolts 65L are disposed at the right side and the left side of the deflector 27L along an up/down pivoting axis E1L extending in the right/left direction LR (only the bolt 65L at the left side is shown in FIG. 6). The reverse gate 28L can be pivoted up and down about the up/down pivoting axis E1L with respect to the deflector 27L. The reverse gate 28L can be pivoted to the right and left together with the deflector 27L.

The reverse gate 28L can be pivoted up and down between a fully opened position and a fully closed position. The fully opened position is a position at which the reverse gate 28L is retreated upward relative to the forward drive jet port 52L of the deflector 27L. The fully opened position is indicated by solid lines in FIG. 6. At the fully opened position, the reverse gate 28L does not cover the forward drive jet port 52L at all when the forward drive jet port 52L is viewed from a downstream side of its water stream jetting direction. On the other hand, the fully closed position is a position at which the reverse gate 28L opposes the forward drive jet port 52L of the deflector 27L. The fully closed position is indicated by phantom lines in FIG. 6. At the fully closed position, the reverse gate 28L covers an entirety of the forward drive jet port 52L when the forward drive jet port 52L is viewed from the downstream side of its water stream jetting direction. At the fully closed position, the reverse gate 28L closes the forward drive jet port 52L and thus the water stream is jetted toward the front from the reverse drive jet port 53L. That is, the water stream that is jetted toward the rear from the jet propulsion machine 3L is turned back toward the front by the reverse gate 28L. "Front" is the direction in which a propulsive force in the reverse drive direction can be applied to the hull 2. That is, the water stream jetting direction when the reverse gate 28L is at the fully closed position does not necessarily have to be parallel to the center line A1 of the hull 2 and suffices to be a direction that has component directed toward the front along the center line A1 of the hull 2.

In the present preferred embodiment, the reverse drive jet port 53L branches downward from a rear end portion of the forward drive jet port 52L. The reverse drive jet port 53L is directed obliquely downward and toward the left front. Thus, when the reverse gate 28L is positioned at the reverse drive position, the water stream jetted from the reverse drive jet port 53L is directed obliquely downward and toward the left front of the hull 2. The reverse drive jet port 53L may be directed obliquely downward and toward the front (in a direction parallel to the centerline A1 in plan view) and be arranged to jet the water stream obliquely downward and toward the front of the hull 2.

As shown in FIG. 5, in the left jet propulsion machine 3L, a portion to the rear relative to the jet nozzle 26L protrudes to the rear of the left recessed portion 18L and is disposed below the deck rear portion 4*a*.

Figures 7, 7A, 7B:
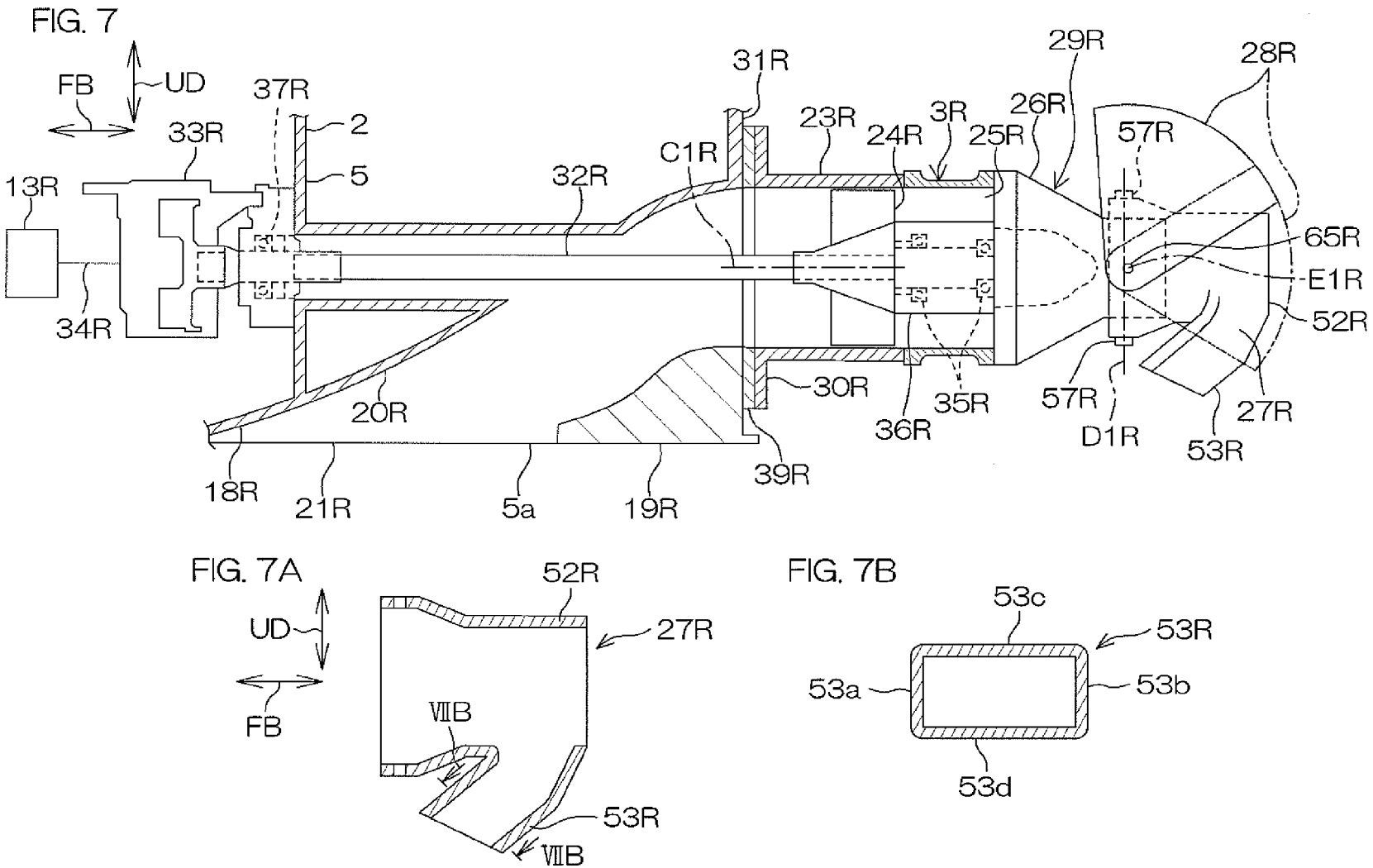
FIG. 7 is a longitudinal sectional view of an arrangement of the right jet propulsion machine and shows a section as viewed from the left side.
FIG. 7A is a longitudinal sectional view of a deflector provided in the right jet propulsion machine.
FIG. 7B is a sectional view taken along line VIIB-VIIB in FIG. 7A.

FIG. 7 is a longitudinal sectional view of an arrangement of the right jet propulsion machine 3R and shows a section as viewed from the left side. FIG. 7A is a longitudinal sectional view of the deflector 27R of the right jet propulsion machine 3R, and FIG. 7B is a lateral sectional view of the deflector 27R (sectional view taken along line VIIB-VIIB in FIG. 7A). The arrangement of the right jet propulsion machine 3R is substantially the same as the arrangement of the left jet propulsion machine 3L. Thus, in FIG. 7, FIG. 7A, and FIG. 7B, portions corresponding to the arrangements already described with the left jet propulsion machine 3L are indicated by reference symbols of the same numbers with the alphabet character "R" and detailed description thereof shall be omitted. The reverse drive jet port 53R is directed obliquely downward and toward the right front. Thus, when the reverse gate 28R is positioned at the reverse drive position, the water stream jetted from the reverse drive jet port 53R is directed obliquely downward and toward the right front of the hull 2. The reverse drive jet port 53R may be directed obliquely downward and toward the front (in a direction parallel or substantially parallel to the center line A1 in plan view) and be arranged to jet the water stream obliquely downward and toward the front of the hull 2.

Figure 8:
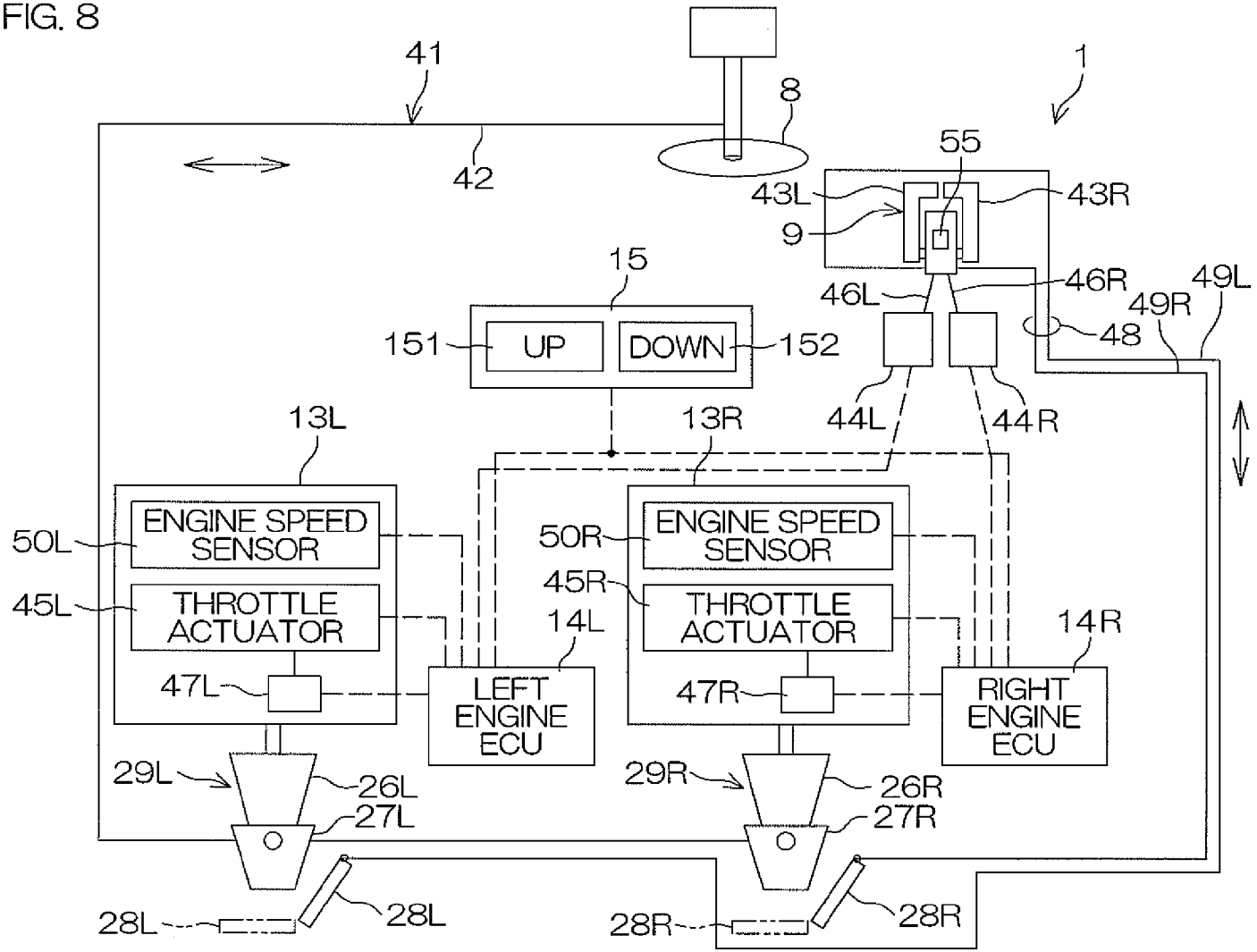
FIG. 8 is a conceptual diagram schematically showing an arrangement related to changing of a heading direction and control of output of the water jet propulsion watercraft.

FIG. 8 is a conceptual diagram schematically showing an arrangement related to changing of a heading direction and control of output of the water jet propulsion watercraft 1. The water jet propulsion watercraft 1 includes a linkage mechanism 41 that pivots the right deflector 27R and the left deflector 27L to the right and left. The linkage mechanism 41 includes the steering wheel 8 and a steering cable 42.

One end of the steering cable 42 is connected to the steering wheel 8. The steering cable 42 preferably is, for example, a push-pull type cable, and is arranged to be pushed and pulled by rotational operation of the steering wheel 8. Another end of the steering cable 42 is connected to the right deflector 27R and the left deflector 27L.

A rotational force of the steering wheel 8 is transmitted to the right deflector 27R and the left deflector 27L via the steering cable 42. The right deflector 27R and the left deflector 27L are thereby pivoted to the right and left.

The remote control unit 9 includes a right lever 43R and a left lever 43L. The levers 43R and 43L are arranged to be pivotable in the front/rear direction about the respective lower ends as pivoting centers. A pivoting operation position of the left lever 43L is detected by a left accelerator position sensor 44L. Likewise, a pivoting operation position of the right lever 43R is detected by a right accelerator position sensor 44R. More specifically, throttle operation cables 46R and 46L, which are displaced in linkage with the operations of the right lever 43R and the left lever 43L, respectively, are led out from the remote control unit 9. The throttle operation cables 46R and 46L are, for example, push-pull type cables that are pushed and pulled by operations of the levers 43R and 43L. Displacements of the throttle operation cables 46R and 46L are detected by the accelerator position sensors 44R and 44L, respectively. The accelerator position sensors 44R and 44L include, for example, potentiometers. The accelerator position sensors 44R and 44L are electrically connected to the right engine ECU 14R and the left engine ECU 14L, respectively, and respectively output signal corresponding to the positions of the levers 43R and 43L (or to be more accurate, the positions of the throttle operation cables 46R and 46L).

The output changing operation unit 15 includes an increase switch 151 and a decrease switch 152. The output changing operation unit 15 is electrically connected to the right engine ECU 14R and the left engine ECU 14L. The output changing operation unit 15 is arranged to input signals expressing operations of the switches 151 and 152 into the right engine ECU 14R and the left engine ECU 14L. The output changing operation unit 15 is arranged to be operated by the operator to adjust the engine outputs during idling. When the increase switch 151 is operated, the engine ECUs 14R and 14L increase the engine outputs during idling. When the decrease switch 152 is operated, the engine ECUs 14R and 14L decrease the engine outputs during idling. More specifically, the engine ECUs 14R and 14L increase and decrease the throttle opening degrees during idling (idling opening degrees; fully closed degrees; fully opened degrees) in response to the operations of the switches 151 and 152. The output changing operation unit 15 is operated by the marine vessel operator mainly during low-speed forward travel.

The left engine 13L includes a left throttle actuator 45L arranged to actuate a throttle valve that opens and closes an air intake passage. The left engine ECU 14L is electrically connected to the left throttle actuator 45L and controls driving of the left throttle actuator 45L. The opening degree of the throttle valve (throttle opening degree) of the left engine 13L is thereby controlled, and as a result, the output of the left engine 13L is controlled. The throttle opening degree of the left engine 13L is detected by a left throttle position sensor 47L and a detection signal thereof is input into the left engine ECU 14L.

Likewise, the right engine 13R includes a right throttle actuator 45R arranged to actuate a throttle valve that opens and closes an air intake passage. The right engine ECU 14R is electrically connected to the right throttle actuator 45R and controls driving of the right throttle actuator 45R. The throttle opening degree of the right engine 13R is thereby controlled, and as a result, the output of the right engine 13R is controlled. The throttle opening degree of the right engine 13R is detected by a right throttle position sensor 47R and a detection signal thereof is input into the right engine ECU 14R.

The throttle operation cables 46R and 46L, the accelerator position sensors 44R and 44L, the engine ECUs 14R and 14L, and related arrangements inside the remote control unit 9 constitute a throttle opening degree operating device (throttle opening degree operating unit).

The engines 13R and 13L include engine speed sensors 50R and 50L, respectively. The engine speed sensors 50R and 50L may, for example, be crank angle sensors that are arranged to detect crank angles of the engines 13R and 13L. Output signals of the engine speed sensors 50R and 50L are input into the right engine ECU 14R and the left engine ECU 14L, respectively. The engine ECUs 14R and 14L control the engines 13R and 13L based on the output signals of the engine speed sensors 50R and 50L.

The water jet propulsion watercraft 1 further includes a gate linkage mechanism 48 that is arranged to displace the right reverse gate 28R and the left reverse gate 28L between the fully opened position and the fully closed position.

The gate linkage mechanism 48 includes gate operation cables 49R and 49L. The gate linkage mechanism 48 and arrangements inside the remote controller 9 that are related thereto constitute a gate position operating device (reverse gate keeping unit). The gate operation cables 49R and 49L are, for example, push-pull type cables that are pushed and pulled by operations of the levers 43R and 43L, respectively. Driving forces corresponding to the operations of the right lever 43R and left lever 43L are respectively applied to ends at one side of the gate operation cables 49R and 49L. Ends at another side of the gate operation cables 49R and 49L are connected to the right reverse gate 28R and the left reverse gate 28L. In FIG. 8, the right reverse gate 28R and the left reverse gate 28L at the fully opened positions are indicated by solid lines, and the right reverse gate 28R and the left reverse gate 28L at the fully closed positions are indicated by phantom lines.

Figure 9:
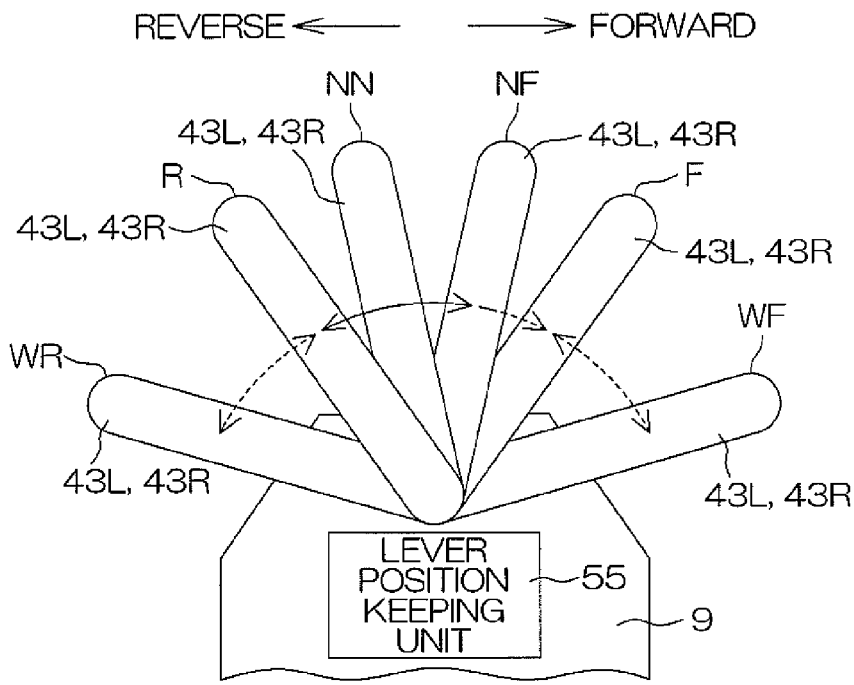
FIG. 9 is a right side view for explaining operation positions of a lever for setting throttle opening degrees and reverse gate opening degrees (gate opening degrees).

FIG. 9 is a right side view for explaining operation positions of the levers 43R and 43L. Each of the levers 43R and 43L is arranged to be tilted between a maximum output forward drive position WF and a maximum output reverse drive position WR. The maximum output forward drive position WF is an operation position for maximizing the propulsive force in the forward drive direction. The maximum output reverse drive position WR is an operation position for maximizing the propulsive force in the reverse drive direction. A neutral position NN is set between the maximum output forward drive position WF and the maximum output reverse drive position WR. Further, a forward drive starting position NF is set between the neutral position NN and the maximum output forward drive position WF. Also, a reverse drive starting position R is set between the neutral position NN and the maximum output reverse drive position WR.

Each of the levers 43R and 43L is arranged to be kept in position at the forward drive starting position NF, the neutral position NN, and the reverse drive starting position R. Specifically, the remote control unit 9 includes a lever position keeping unit 55 (lever position keeping unit) arranged to keep each of the levers 43R and 43L at the positions NF, NN, and R.

Figure 10:
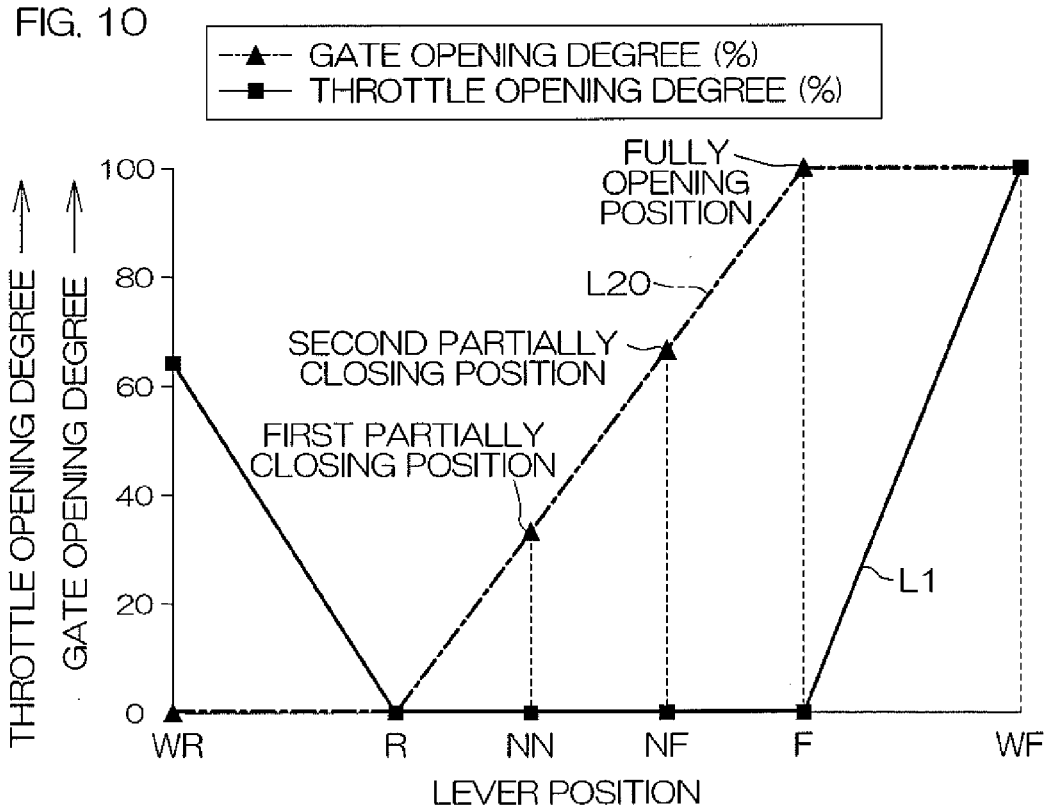
FIG. 10 is a diagram of an example of a relationship between the lever operation position and the throttle opening degree and the gate opening degree.

FIG. 10 is a diagram of an example of a relationship between the operation position of each of the levers 43R and 43L (hereinafter referred to collectively as the "lever 43") and the position of each of the reverse gates 28R and 28L (hereinafter referred to collectively as the "reverse gate 28") and the throttle opening degree. The reverse gate 28 is displaced between the fully closed position (gate opening degree: 0%) and the fully opened position (gate opening degree: 100%). When the lever 43 is positioned in a range between the maximum output reverse drive position WR and the reverse drive starting position R, the reverse gate 28 is kept at the fully closed position (gate opening degree: 0%). When the lever 43 is positioned at a gate fully opened position F set between the forward drive starting position NF and the maximum output forward drive position WF, the reverse gate 28 is at the fully opened position (gate opening degree: 100%). When the lever 43 is positioned between the gate fully opened position F and the maximum output forward drive position WF, the reverse gate 28 is kept at the fully opened position (gate opening degree: 100%). When the lever 43 is positioned between the reverse drive starting position R and the gate fully opened position F, the reverse gate 28 is positioned at an intermediate opening degree position between the fully opened position and the fully closed position. That is, the reverse gate 28 is positioned at an opening degree position that is in accordance with the position of the lever 43. More specifically, a displacement amount of the reverse gate 28 toward the fully opened position side with respect to the fully closed position corresponds to a displacement amount of the lever 43 toward the gate fully opened position F side with respect to the reverse drive starting position R. Put another way, when the lever 43 is positioned between the reverse drive starting position R and the gate fully opened position F, the position of the reverse gate 28 changes in conformance to the position of the lever 43.

When the lever 43 is at the neutral position NN, the reverse gate 28 is positioned at a first partially closed position. When the lever 43 is at the forward drive starting position NF, the reverse gate 28 is positioned at a second partially closed position. The second partially closed position is closer to the fully opened position than the first partially closed position. Put another way, the opening degree of the reverse gate 28 (hereinafter referred to as "gate opening degree") at the second partially closed position is greater than the gate opening degree at the first partially closed position. In the example of FIG. 10, the gate opening degree at the first partially closed position is approximately 35% and the gate opening degree at the second partially closed position is approximately 70%. The gate opening degree is an index with which an entire pivoting angle range of the reverse gate 28 is divided into 100 equal parts and is 0% at the fully closed position and 100% at the fully opened position.

The first partially closed position is set so that the propulsive force in the forward drive direction and the propulsive force in the reverse drive direction are substantially balanced and the position of the hull can be kept. The second partially closed position is set so that the propulsive force in the forward drive direction is greater than the propulsive force in the reverse drive direction.

When the lever 43 is between the reverse drive starting position R and the neutral position NN, the reverse gate 28 is displaced continuously from the fully closed position to the first partially closed position in conformance to the operation amount of the lever 43 from the reverse drive starting position R. Also, when the lever 43 is between the neutral position NN and the forward drive starting position NF, the reverse gate 28 is displaced continuously from the first partially closed position to the second partially closed position in conformance to the operation amount of the lever 43 from the neutral position NN. Further, when the lever 43 is positioned between the forward drive starting position NF and the gate fully opened position F, the reverse gate 28 is displaced continuously from the second partially closed position to the fully opened position in conformance to the operation amount of the lever 43 from the forward drive starting position NF.

The throttle opening degrees are controlled by the engine ECUs 14R and 14L (hereinafter referred to collectively as the "engine ECU 14") in accordance with the position of the lever 43 detected by the accelerator position sensors 44R and 44L (hereinafter referred to collectively as the "accelerator position sensor 44"). In the present preferred embodiment, the accelerator position sensor 44, to be accurate, is arranged to detect the positions of the throttle operation cables 46R and 46L.

Along a characteristic line L1 shown in FIG. 10, the throttle opening degree is kept at a predetermined first opening degree (for example, 0%; fully closed; idling opening degree) at a lever position from the reverse drive starting position R to the gate fully opened position F. In the range from the gate fully opened position F to the maximum output forward drive position WF, the throttle opening degree is set to increase in conformance to the displacement amount (operation amount) of the lever 43 from the gate fully opened position F. Further, when the lever 43 is positioned at the maximum output forward drive position WF, the throttle opening degree is set to an upper limit value (100%; fully open). In the range from the reverse drive starting position R to the maximum output reverse drive position WR, the throttle opening degree is set to increase in conformance to the displacement amount (operation amount) of the lever 43 from the reverse drive starting position R. When the lever 43 is positioned at the maximum output reverse drive position WR, the throttle opening degree is set to a predetermined reverse drive upper limit value (for example, approximately 65%).

FIG. 11A to FIG. 11D are figures for explaining positions of the reverse gate 28. In each figure, a sectional view of a vicinity of the reverse gate 28 is shown at the left side, and a rear view of the reverse gate 28 and the deflector 27 (diagram as viewed from the rear of the hull 2) is shown at the right side.

Figure 11A:
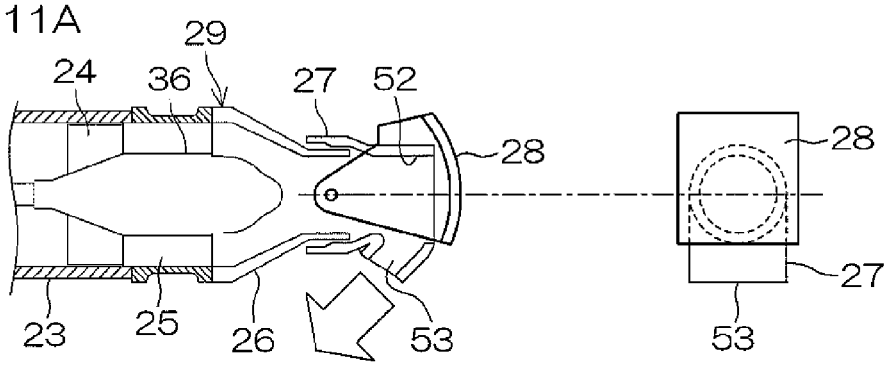
FIG. 11A to FIG. 11D are figures for explaining positions of the reverse gate.

FIG. 11A shows the fully closed position (gate opening degree: 0%). When viewed from the downstream side of the water stream jetting direction of each of the forward drive jet ports 52R and 52L (hereinafter referred to collectively as the "forward drive jet port 52") of the deflectors 27R and 27L (hereinafter referred to collectively as the "deflector 27"), the reverse gate 28 covers the entirety of the forward drive jet port 52. That is, the gate opening degree is 0%. The fully closed position is a lowermost position of the reverse gate 28. The deflector 27 jets water streams toward the lower front of the hull 2 from the reverse drive jet ports 53R and 53L (hereinafter referred to collectively as the "reverse drive jet port 53"). A water stream to the rear is hardly generated.

Figure 11B:
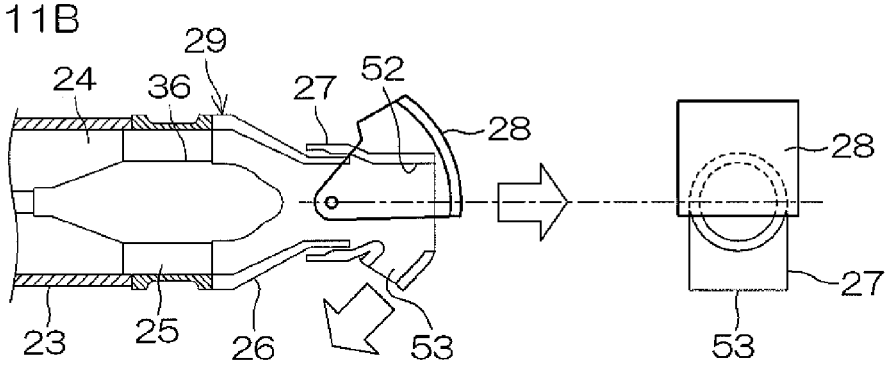

FIG. 11B shows the first partially closed position (gate opening degree: approximately 35%). When viewed from the downstream side of the water stream jetting direction, the reverse gate 28 covers only a portion of the forward drive jet port 52. In the present example, approximately 65% (more than 50%) of an opening area of the forward drive jet port 52 is covered and thus the gate opening degree is approximately 35% (less than 50%). The first partially closed position is a position that is above the fully closed position. A water stream is jetted toward the rear of the hull 2 from the region of the forward drive jet port 52 that is not covered by the reverse gate 28. A water stream is also jetted to the lower front of the hull 2 from the reverse drive jet port 53. The water stream directed to the front of the hull 2 is less than that in the fully closed position state.

Figure 11C:
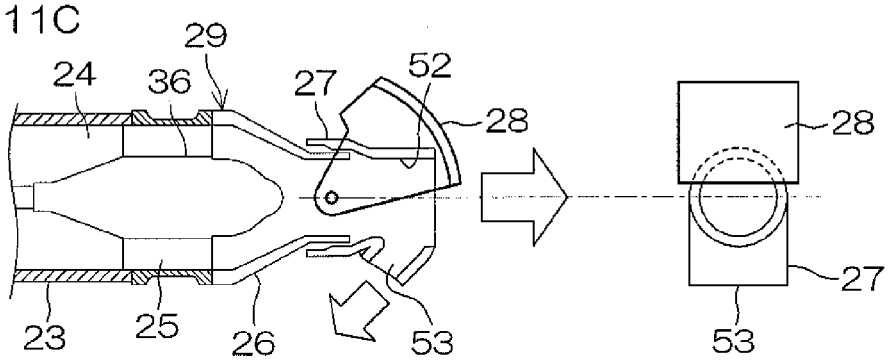

FIG. 11C shows the second partially closed position (gate opening degree: approximately 70%). When viewed from the downstream side of the water stream jetting direction, the reverse gate 28 covers only a portion of the forward drive jet port 52. In the present example, approximately 30% (less than 50%) of the opening area of the forward drive jet port 52 is covered and thus the gate opening degree is approximately 70% (more than 50%). The second partially closed position is a position above the first partially closed position. The reverse gate 28 thus covers the forward drive jet port 52 over an area that is less than that in the first partially closed position state. A water stream is jetted toward the rear of the hull 2 from the region of the forward drive jet port 52 that is not covered by the reverse gate 28. A water stream is also jetted to the lower front of the hull 2 from the reverse drive jet port 53. The water stream directed to the rear of the hull 2 is more than that in the first partially closed position. The water stream directed to the front of the hull 2 is less than that in the first partially closed position state.

Figure 11D:
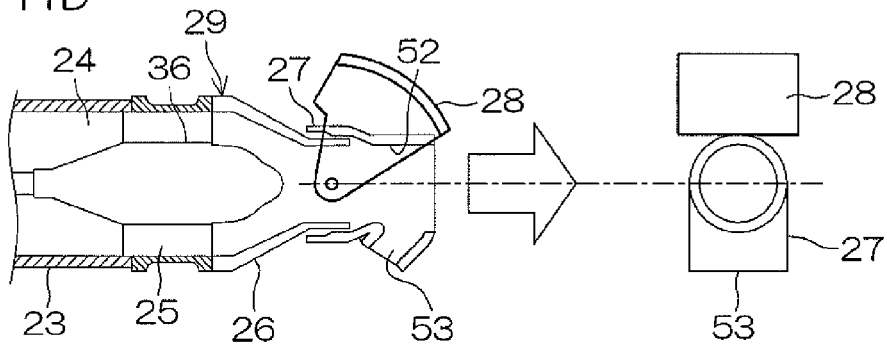

FIG. 11D shows the fully opened position (gate opening degree: 100%). When viewed from the downstream side of the water stream jetting direction, the reverse gate 28 does not cover the forward drive jet port 52 at all. That is, the gate opening degree is 100%. The fully opened position is an uppermost position of the reverse gate 28 and is a position higher than the second partially closed position. The deflector 27 jets the water stream toward the rear of the hull 2 from the forward drive jet port 52. A water stream to the front of the hull 2 is hardly generated.

Figure 12:
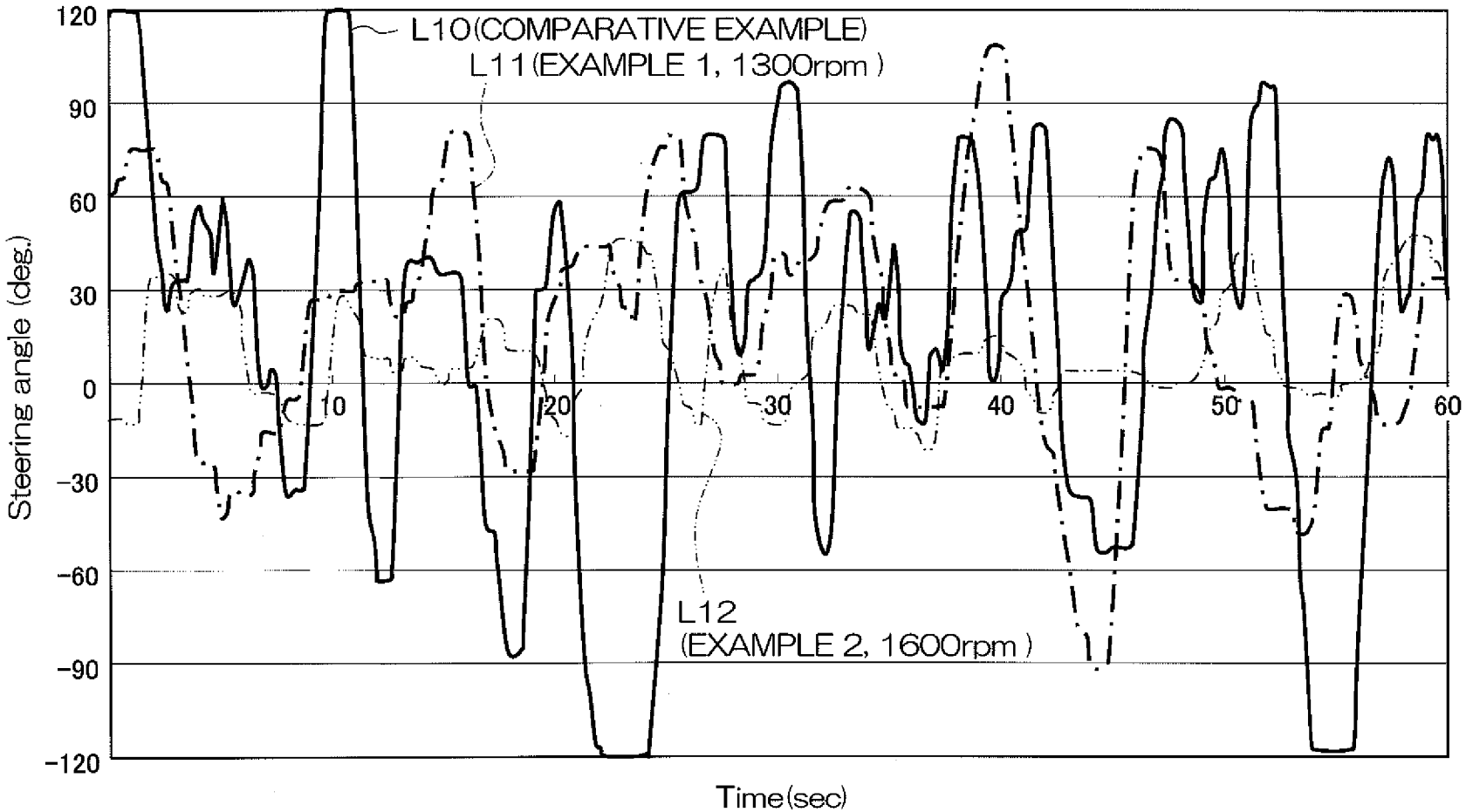
FIG. 12 is a diagram of results of an experiment conducted by the inventor to compare operation performance during low-speed travel.

FIG. 12 is a diagram of results of an experiment conducted by the present inventor to compare operation performance during low-speed travel. A curve L10 indicates an experimental result of a comparative example, and curves L11 and 12 indicate experimental results of examples that are in accordance with the preferred embodiment of the present invention described above. All curves indicate changes in time of steering operations (steering angles) performed by the marine vessel operator to make the hull travel straight. An ordinate indicates the steering angle, and an abscissa indicates the time. The steering angle is expressed with a steering angle midpoint being 0 degrees, a steering angle to the right side taking on a positive value, and a steering angle to the left side taking on a negative value.

With the comparative example (curve L10), the forward drive jet port 52 of the deflector 27 was not covered at all by the reverse gate 28 when viewed from the downstream side of the water stream jetting direction, and the gate opening degree was set to approximately 100% (fully opened position; see FIG. 11D). Also, the engine speed was set to 1300 rpm. With Example 1, (curve L11), approximately 30% of the opening area of the forward drive jet port 52 was covered by the reverse gate 28 when viewed from the downstream side of the water stream jetting direction, and the gate opening degree was set to approximately 70% (second partially closed open position; see FIG. 11C). Also, the engine speed was set to 1300 rpm. With Example 2, (curve L12), approximately 30% of the opening area of the forward drive jet port 52 was covered by the reverse gate 28 when viewed from the downstream side of the water stream jetting direction, and the gate opening degree was set to approximately 70% (second partially closed open position; see FIG. 11C). Also, the output changing operation unit 15 was operated and the engine speed was set to 1600 rpm.

From a comparison of the curves L10, L11, and L12, it can be seen that the steering angle change is significantly lessened in Example 1 and Example 2 than in the comparative example. That is, the hull can be made to travel straight with a low steering amount (steering period and steering angle). This is because the response of the hull with respect to the steering wheel operation is good and an appropriate steering direction and steering amount can be grasped readily. Further, the steering angle change is less with Example 2 than with Example 1. This is because the engine speed is higher in Example 2 and thus a faster response can be obtained with respect to the steering wheel operation.

When the reverse gate 28 is at the second partially closed position, the hull 2 can be driven forward while applying an appropriate braking force to the hull 2 by the propulsive force in the reverse drive direction. The turning of the hull 2 due to inertia can thereby be canceled out immediately. Thus, when the water jetting direction is changed to the right or the left by operation of the steering wheel 8, the hull behavior that is in accordance with the operation is achieved immediately. Excellent response with respect to the steering wheel operation is thus obtained and an excellent maneuvering performance can be realized. Moreover, there is no need to provide a large skeg or rudder, and thus a large resistance against gliding does not arise when the hull 2 is made to glide on the water surface at high speed and ease of boarding and exiting from the stern does not have to be sacrificed.

Thus, with the present preferred embodiment, when the lever 43 is set at the forward drive starting position, the reverse gate 28 is positioned at the second partially closed position and the response of hull behavior with respect to steering wheel operation is made fast. Excellent maneuvering performance can thus be realized during low-speed travel. Moreover, the lever 43 is kept at the forward drive starting position NF, and thus after setting the lever 43 at the forward drive starting position, the marine vessel operator can concentrate on the steering wheel operation. Complicated operations are thus not necessary and marine vessel maneuvering during low-speed travel is made easy.

Figure 13A:
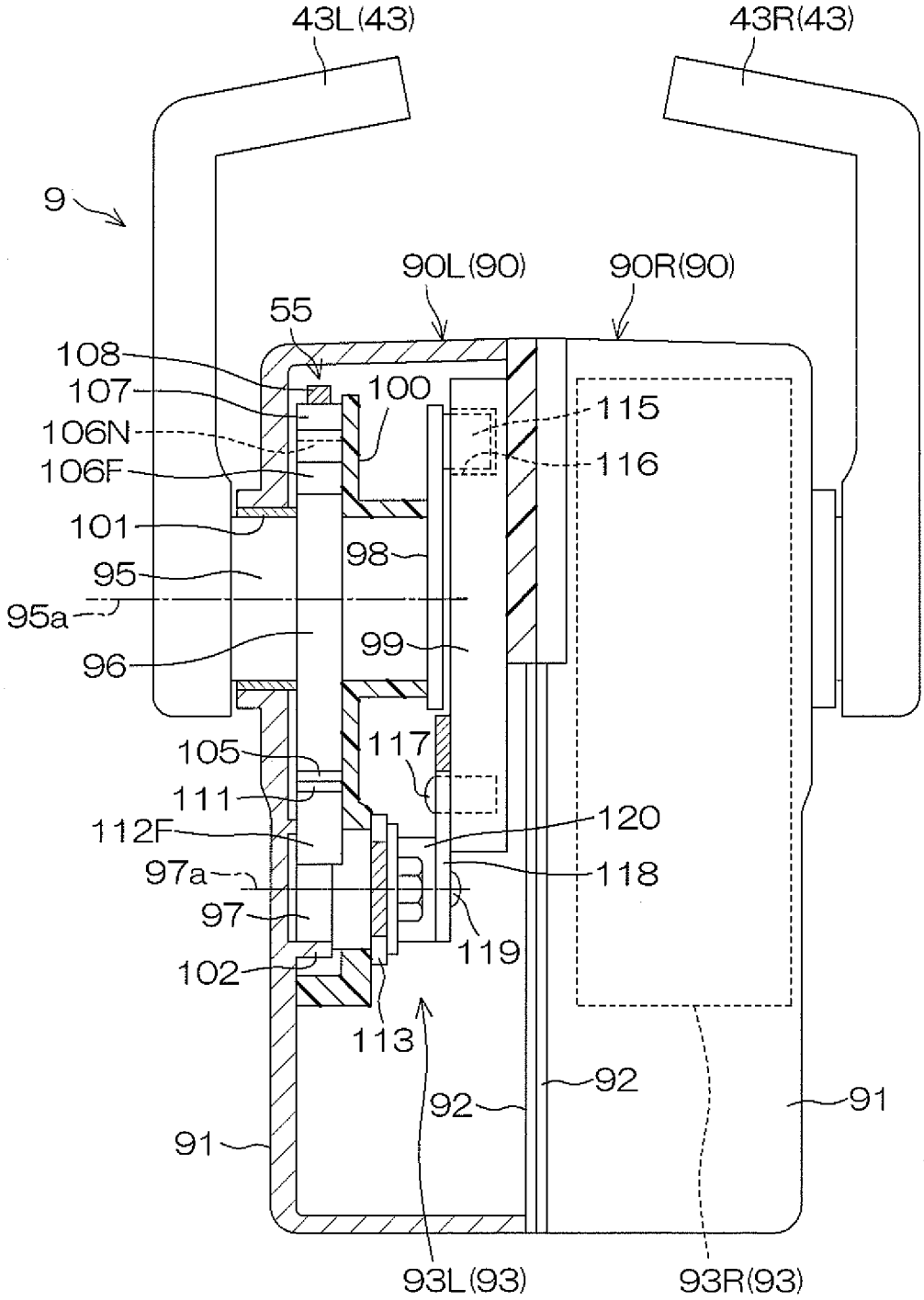
FIG. 13A is a longitudinal sectional view, as viewed from the rear of the hull, of a remote control unit that includes the lever.
Figure 13B:
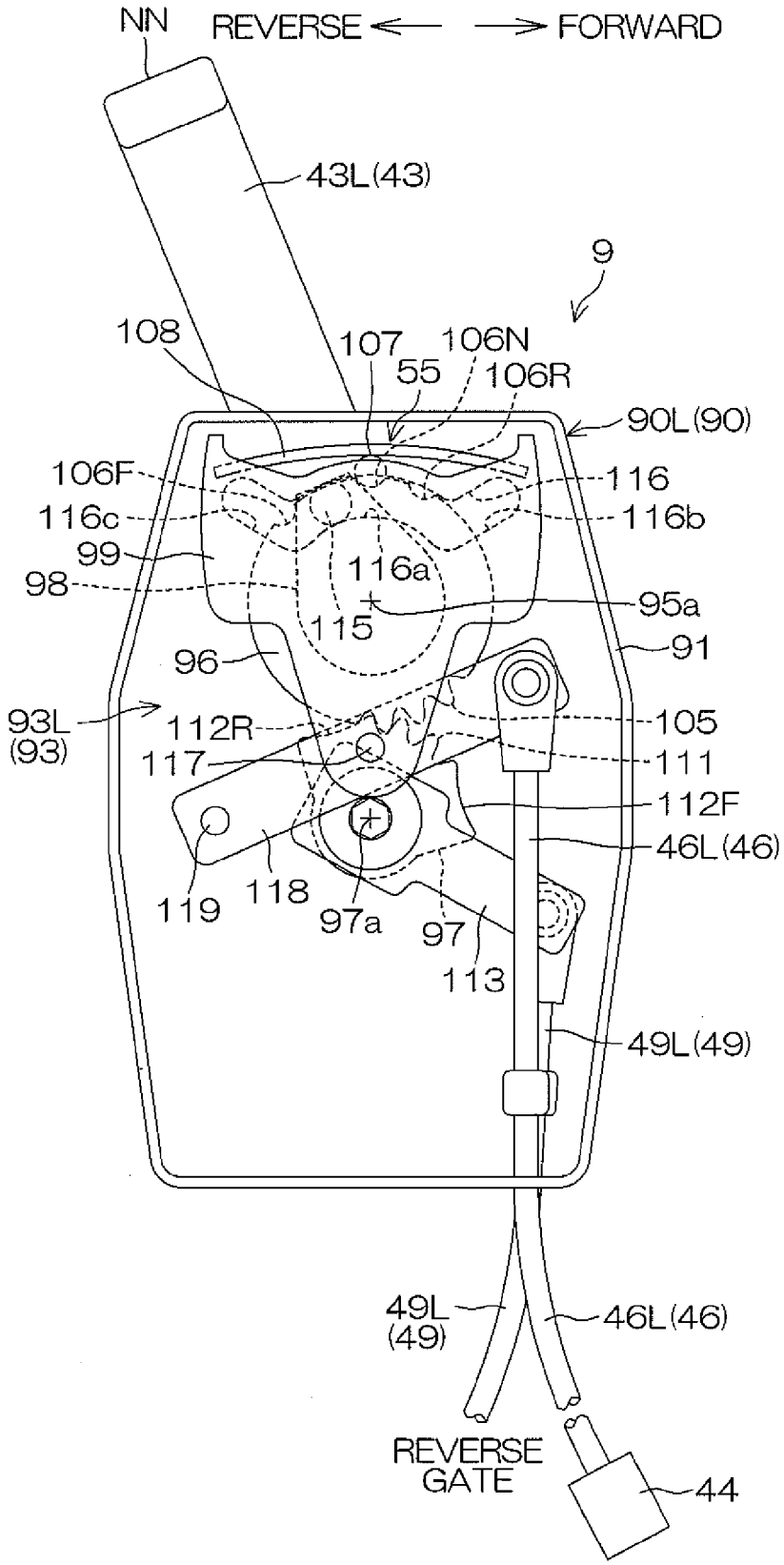
FIG. 13B is a right side view of an internal arrangement of a left half of the remote control unit and shows a state in which the lever is at a neutral position.
Figure 13C:
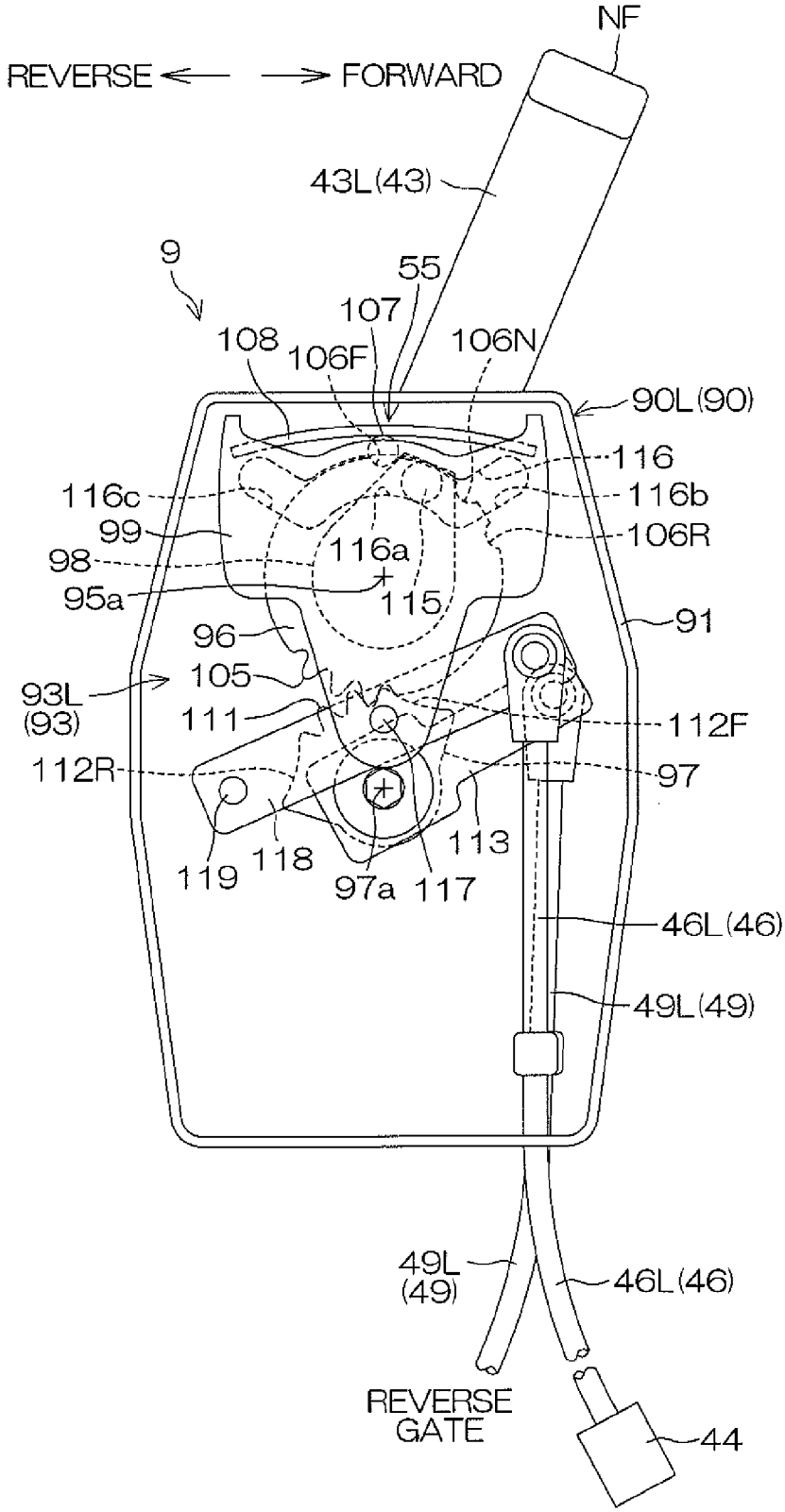
FIG. 13C is a right side view of the internal arrangement of the left half of the remote control unit and shows a state in which the lever is at a forward drive starting position.
Figure 13D:
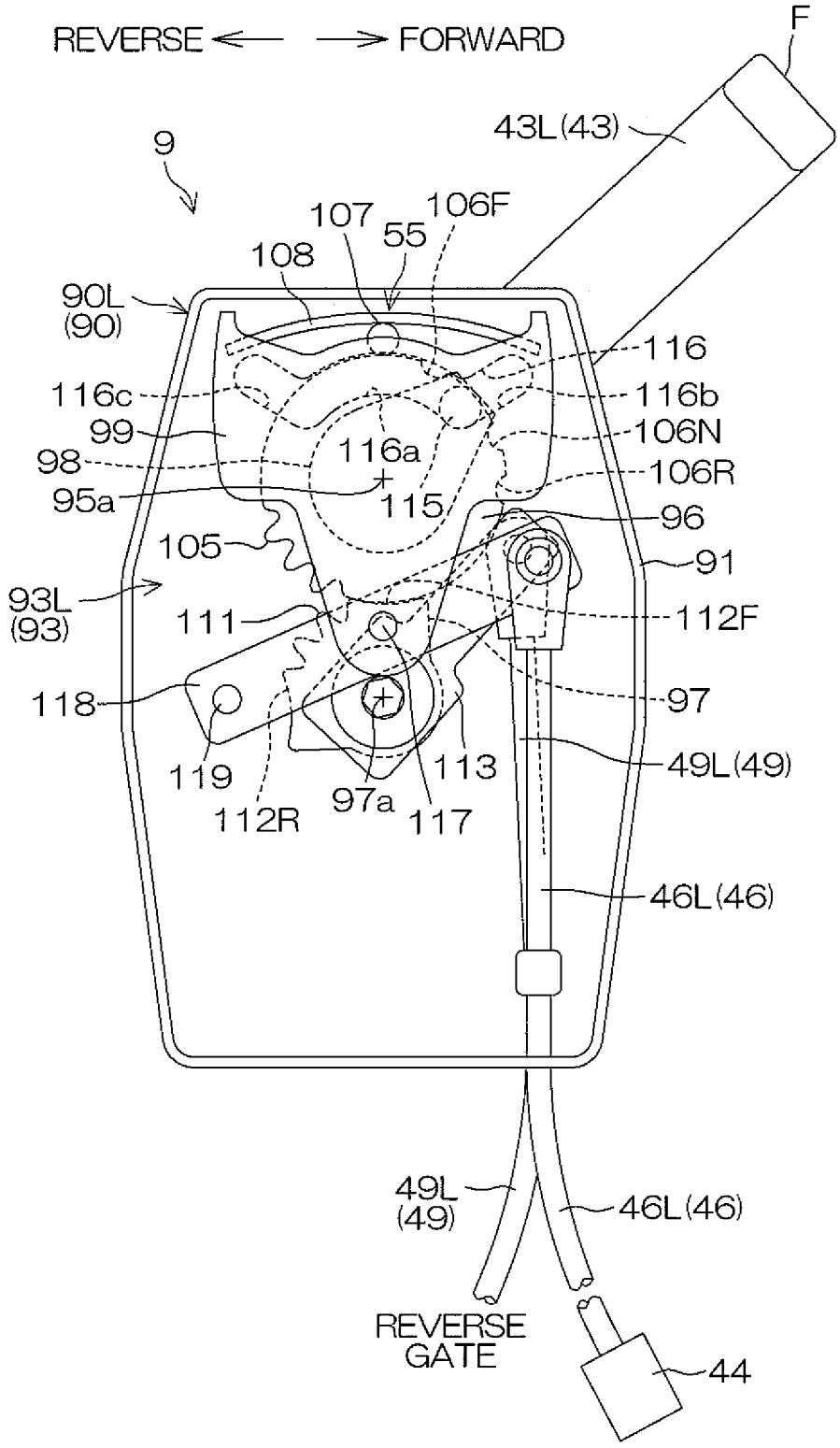
FIG. 13D is a right side view of the internal arrangement of the left half of the remote control unit and shows a state in which the lever is at a gate fully opened position.
Figure 13E:
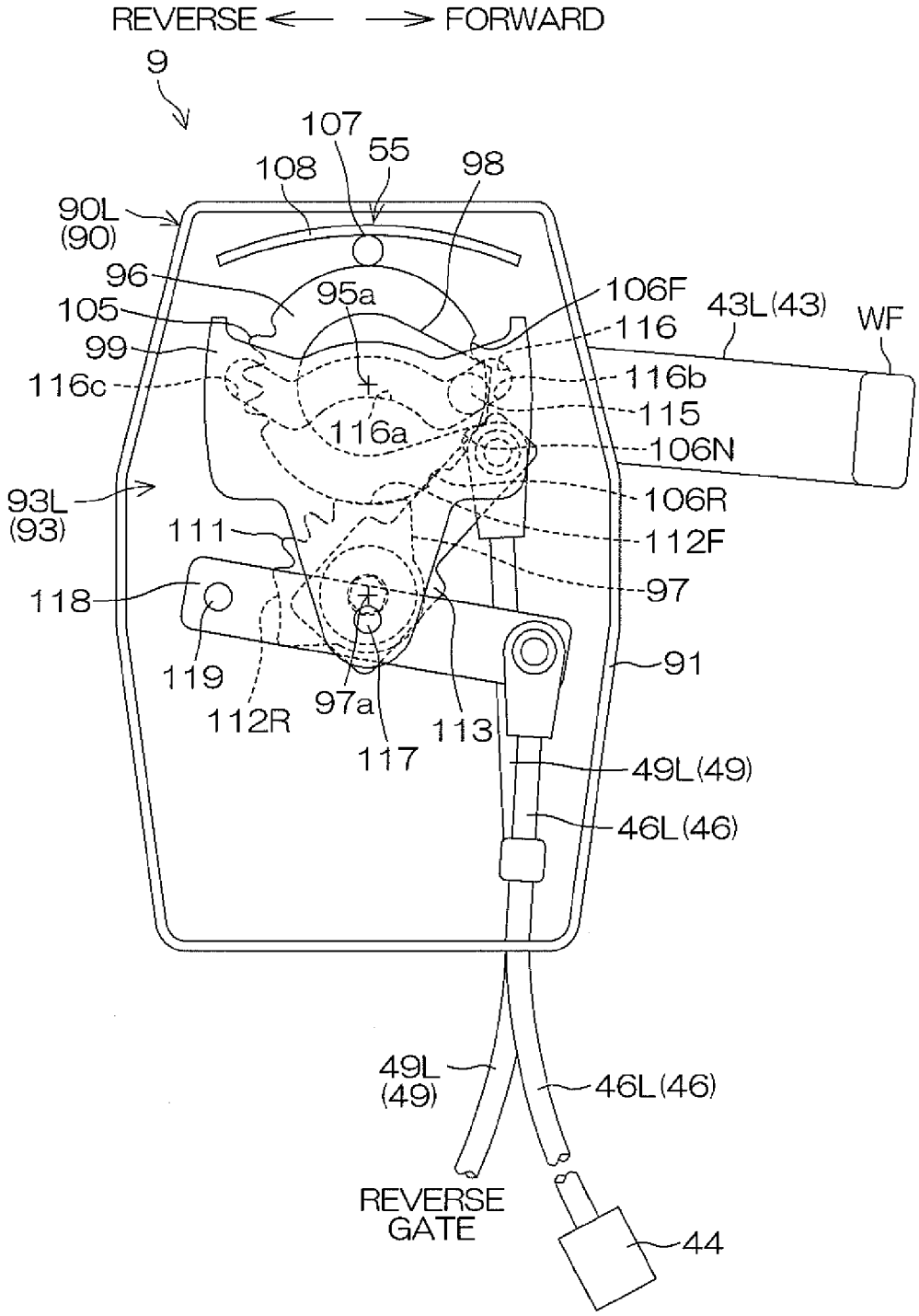
FIG. 13E is a right side view of the internal arrangement of the left half of the remote control unit and shows a state in which the lever is at a maximum output forward drive position.
Figure 13F:
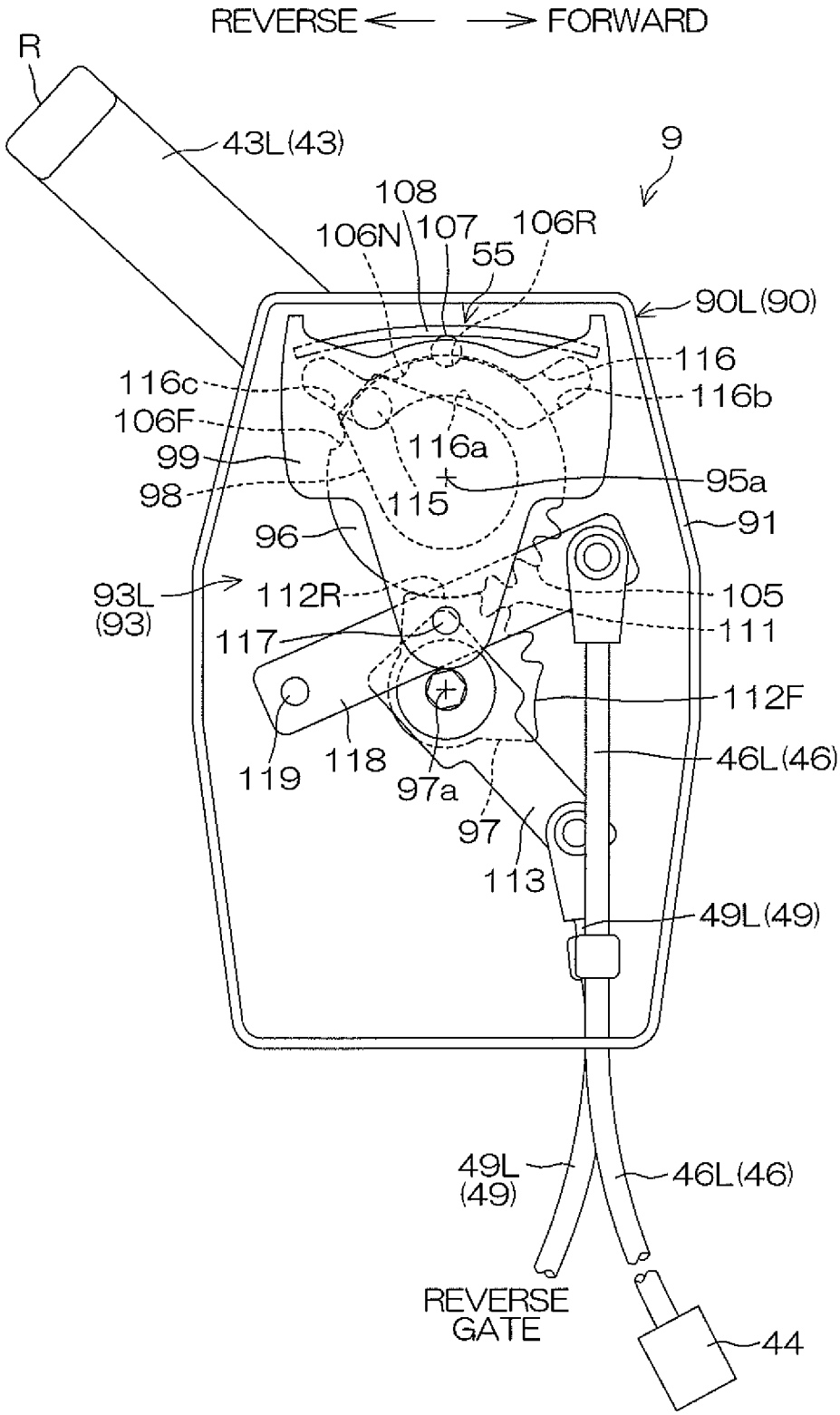
FIG. 13F is a right side view of the internal arrangement of the left half of the remote control unit and shows a state in which the lever is at a reverse drive starting position.
Figure 13G:
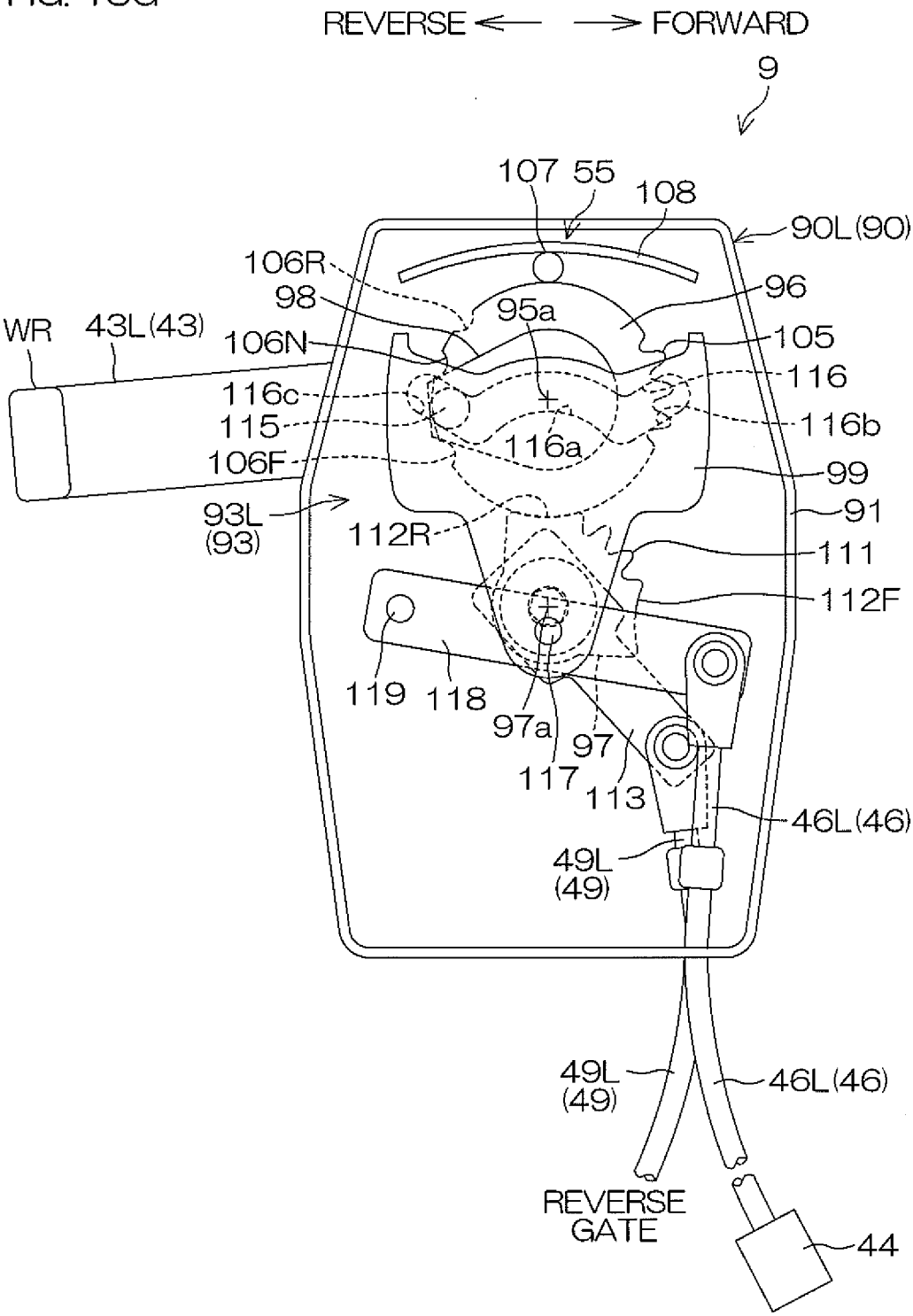
FIG. 13G is a right side view of the internal arrangement of the left half of the remote control unit and shows a state in which the lever is at a maximum output reverse drive position.

FIG. 13A to FIG. 13G show a specific structural example of the remote control unit 9. FIG. 13A is a longitudinal sectional view of the remote control unit 9 as viewed from the rear of the hull. FIG. 13B to 13G are right side views of an internal arrangement of a left half of the remote control unit 9 and respectively show states in which the lever position is at the neutral position NN (FIG. 13B), the forward drive starting position NF (FIG. 13C), the gate fully opened position F (FIG. 13D), the maximum output forward drive position WF (FIG. 13E), the reverse drive starting position R (FIG. 13F), and the maximum output reverse drive position WR (FIG. 13G).

The remote control unit 9 includes the pair of levers 43R and 43L, a pair of housings 90R and 90L (referred to as the "housing 90" when referred to collectively), and a pair of mechanism portions 93R and 93R (referred to as the "mechanism portion 93" when referred to collectively). The housings 90R and 90L correspond to the levers 43R and 43L, respectively. The mechanism portions 93R and 93L are housed inside the housings 90R and 90L, respectively. The housings 90R and 90L and internal structures thereof are arranged in a right/left symmetrical manner in correspondence to the levers 43R and 43L. The housings 90R and 90L constitute the remote control unit 9 by being mutually connected at side surfaces at sides opposite to the portions connected to the levers 43R and 43L.

The arrangement of the interior of the housing 90L is shown only in relation to the lever 43L in FIG. 13A. The internal arrangement of the housing 90L is shown in FIG. 13B to FIG. 13G. The arrangement related to the lever 43R is right/left symmetrical and thus the arrangement related to the lever 43L shall be described as a representative example.

The housing 90 includes a container-like main housing body 91 having an opening in one direction and a lid body 92 that closes the opening. The mechanism portion 93 includes a drive axis 95, a main gear member 96, a gate drive gear member 97, a main drive arm 98, a throttle drive cam member 99, and a gear case 100. However, in FIG. 13B to FIG. 13G, illustration of the gear case 100 is omitted.

The gear case 100 is fixed to the main housing body 91. The drive axis 95 penetrates through the gear case 100 and the main housing body 91. Penetrating holes are formed in mutually opposing wall surfaces of the gear case 100 and the main housing body 91, and a bearing 101 is attached to the penetrating holes. The drive axis 95 is supported by the bearing 101 and is made freely rotatable about its central axis 95*a*. A base end portion of the lever 43 is connected to an end portion of the drive axis 95 positioned outside the main housing body 91. The lever 43 is thus arranged to be freely pivotable about the drive axis 95 as a pivoting center.

Inside the gear case 100, the main gear member 96 is fixed to the drive axis 95. The main gear member 96 thus rotates together with the drive axis 95. The main gear member 96 includes a drive teeth portion 105 at a portion in a circumferential direction, and includes a plurality of (for example, preferably three in the present preferred embodiment) recessed portions 106N, 106F, and 106R at other portions in the circumferential direction. The recessed portions 106N, 106F, and 106R are disposed in a mutually spaced manner at positions substantially opposite to the drive teeth portion 105 with respect to a rotation center (drive axis 95) of the main gear member 96. In the present preferred embodiment, a distance between the recessed portion 106N and the recessed portion 106R is shorter than a distance between the recessed portion 106N and the recessed portion 106F. However, the distance between the recessed portion 106N and the recessed portion 106R may be made equal to the distance between the recessed portion 106N and the recessed portion 106F. Also, the distance between the recessed portion 106N and the recessed portion 106R may be made longer than the distance between the recessed portion 106N and the recessed portion 106F.

The recessed portions 106N, 106F, and 106R are engageable with a click member 107 attached to the main housing body 91. The click member 107 has, for example, a shape of a round bar. An elastic force directed toward an outer circumferential portion of the main gear member 96 is applied to the click member 107 by a spring member 108 attached to the main housing body 91. Thus, when the recessed portion 106N, 106F, or 106R is at an opposing position, the click member 107 fits elastically therein and keeps the rotational angle position of the main gear member 96. The main gear member 96 having the recessed portions 106N, 106F, and 106R, the click member 107, and the spring member 108 make up the lever position keeping unit 55 that keeps the position of the lever 43.

The gate drive gear member 97 is housed inside the gear case 100. The gate drive gear member 97 is supported in a freely rotatable manner by a cylindrical bearing portion 102 disposed on an inner wall surface of the main housing body 91. The gate drive gear member 97 is thereby made freely rotatable about a rotation axis 97*a* parallel to the drive axis 95. The gate drive gear member 97 includes a driven teeth portion 111 that meshes with the drive teeth portion 105 and a pair of concavely curved surfaces 112R and 112F arranged at respective sides of the driven teeth portion 111. The concavely curved surfaces 112R and 112F have curvatures that are substantially equal to that of the outer circumferential surface of the main gear member 96. When the driven teeth portion 111 is meshed with the drive teeth portion 105, the gate drive gear member 97 rotates in conformance to the rotation of the main gear member 96. When the driven teeth portion 111 is not meshed with the drive teeth portion 105, the concavely curved surface 112R or 112F opposes the main gear member 96. In this state, the gate drive gear member 97 does not rotate even when the main gear member 96 rotates.

A gate drive arm 113 is fixed to the gate drive gear member 97. A base end portion of the gate drive arm 113 is fixed to the gate drive gear member 97. The gate drive arm member 113 thus pivots together with the gate drive gear member 97. In this process, a free end of the gate drive arm 113 moves along an arcuate locus centered about the rotation axis 97*a*. End portions at one side of the gate operation cables 49R and 49L (see FIG. 8; referred to as the "gate operation cable 49" when referred to collectively) are connected to the free end of the gate drive arm 113.

The main drive arm 98 is fixed to the drive axis 95 and is arranged to rotate together with the drive axis 95. More specifically, a base end portion of the main drive arm 98 is fixed to the drive axis 95. The main drive arm 98 rotates together with the drive axis 95. A free end thereof moves along an arcuate locus centered about the drive axis 95. A roller 115 is attached to the free end of the main drive arm 98.

The throttle drive cam member 99 is arranged to be slidable along a predetermined direction (up/down direction in FIG. 13A) parallel to an inner wall surface of the lid body 92. A cam groove 116 is formed in a surface of the throttle drive cam member 99 that opposes the main drive arm 98. The roller 115 of the main drive arm 98 is positioned inside the cam groove 116. The roller 115 thus moves inside the cam groove 116 in accordance with the pivoting of the main drive arm 98. The cam groove 116 preferably has a substantially W-shaped configuration, has, at its center, an arcuate portion 116*a* that is convex upward, and has, at respective sides thereof, rectilinear portions 116*b* and 116*c* that are directed diagonally upward and outward. A curvature of the arcuate portion 116*a* is substantially equal to a curvature of the locus of the roller 115. Thus, when the roller 115 moves inside the arcuate portion 116*a*, the throttle drive cam member 99 does not move up and down. When the roller 115 moves inside the rectilinear portion 116*b* or 116*c*, the throttle drive cam member 99 moves up and down.

A lower end portion of the throttle drive cam member 99 is connected by a pin 117 to an intermediate portion of a throttle drive arm 118. Abase end portion of the throttle drive arm 118 is connected in a freely pivotable manner to a fixed shaft 119. The fixed shaft 119 is fixed to the main housing body 91 via a supporting member 120. Thus, when the throttle drive cam member 99 moves up and down, the throttle drive arm 118 pivots about the fixed shaft 119 and a free end thereof moves along an arcuate locus. One end portion of the throttle operation cable 46 (see FIG. 8) is connected to the free end of the throttle drive arm 118.

When the lever 43 is at the neutral position NN, the click member 107 fits into the central recessed portion 106N of the main gear member 96 as shown in FIG. 13B. In this state, the drive teeth portion 105 of the main gear member 96 opposes the gate drive gear member 97 and is meshed with the driven teeth portion 111 thereof. Pivoting of the gate drive gear member 97 is restricted because the pivoting of the main gear member 96 is restricted by the click member 107 and the drive teeth portion 105 and the driven teeth portion 111 are meshed. The reverse gate 28 is thereby kept at the first partially closed position (see FIG. 10 and FIG. 11B). Meanwhile, the roller 115 of the main drive arm 98 is positioned inside the arcuate portion 116*a* of the cam groove 116. The throttle drive cam member 99 is thus kept at an initial position. The accelerator position sensor 44 thus detects the initial position of the throttle operation cable 46. The engine ECU 14 accordingly sets the throttle opening degree to the first opening degree (idling opening degree; fully closed opening degree) (see FIG. 10).

When the lever 43 is operated from the neutral position NN to the forward drive starting position NF, the main gear member 96 pivots, and as shown in FIG. 13C, the click member 107 moves out of the recessed portion 106N and fits into the recessed portion 106F. The rotation of the main gear member 96 is transmitted to the gate drive gear member 97 by the drive teeth portion 105 and the driven teeth portion 111 and causes the gate drive gear member 97 to pivot. The gate drive arm 113 thus pivots and pulls the gate operation cable 49. The reverse gate 28 accordingly moves toward the second partially closed position (see FIG. 11C) and reaches the second partially closed position when the click member 107 fits into the recessed portion 106F (see FIG. 10). The drive teeth portion 105 of the main gear member 96 opposes the gate drive gear member 97 and is meshed with the driven teeth portion 111 thereof at the forward drive starting position NF as well. Pivoting of the gate drive gear member 97 is restricted because the pivoting of the main gear member 96 is restricted by the click member 107 and the drive teeth portion 105 and the driven teeth portion 111 are meshed. The reverse gate 28 is thereby kept at the second partially closed position (see FIG. 11C). Meanwhile, in the process in which the lever 43 moves from the neutral position NN to the forward drive starting position NF, the roller of the main drive arm 98 moves through the arcuate portion 116*a* of the cam groove 116. The roller 115 is positioned in the arcuate portion 116*a* at the forward drive starting position NF as well. The throttle drive cam member 99 is thus kept at the initial position. The accelerator position sensor 44 thus detects the initial position of the throttle operation cable 46. The engine ECU 14 accordingly keeps the throttle opening degree at the first opening degree (idling opening degree; fully closed opening degree) (see FIG. 10).

When the lever 43 is operated from the forward drive starting position NF to the gate fully opened position F, the main gear member 96 pivots further as shown in FIG. 13D. In this process, the click member 107 moves out from the recessed portion 106F. At the gate fully opened position F, the click member 107 is not fitted in any of the recessed portions. The rotation of the main gear member 96 is transmitted to the gate drive gear member 97 by the drive teeth portion 105 and the driven teeth portion 111 and causes the gate drive gear member 97 to pivot. The gate drive arm 113 thus pivots and pulls the gate operation cable 49. The reverse gate 28 accordingly moves toward the fully opened position (see FIG. 11D) and reaches the fully opened position when the lever 43 reaches the gate fully opened position F (see FIG. 10). At the gate fully opened position F, the drive teeth portion 105 of the main gear member 96 is shifted away from the direction of the gate drive gear member 97 and the meshing with the driven teeth portion 111 is disengaged. That is, the arcuate outer circumferential portion of the main gear member 96 opposes the concavely curved surface 112F at one side of the gate drive gear member 97. In other words, the main gear member 96 is fitted in the concavely curved surface 112F. Pivoting of the gate drive gear member 97 is thereby restricted, and the reverse gate 28 is kept at the fully opened position (see FIG. 11D). Meanwhile, in the process in which the lever 43 moves from the forward drive starting position NF to the gate fully opened position F, the roller 115 of the main drive arm 98 moves through the arcuate portion 116*a* of the cam groove 116. At the gate fully opened position F, the roller 115 of the main drive arm 98 is positioned at one end of the arcuate portion 116*a* of the cam groove 116. The throttle drive cam member 99 is thus kept at the initial position. The accelerator position sensor 44 thus detects the initial position of the throttle operation cable 46. The engine ECU 14 accordingly keeps the throttle opening degree at the first opening degree (idling opening degree; fully closed opening degree) (see FIG. 10).

When the lever 43 is operated further from the gate fully opened position F toward the maximum output forward drive position WF, the main gear member 96 pivots further as shown in FIG. 13E. The arcuate outer circumferential portion of the main gear member 96 moves while sliding along the concavely curved surface 112F of the gate drive gear member 97. The gate drive gear member 97 thus does not pivot, and the reverse gate 28 is thus kept at the fully opened position (see FIG. 10 and FIG. 11D). Meanwhile, the roller 115 of the main drive arm 98 departs from the arcuate portion 116*a* of the cam groove 116 and moves through the rectilinear portion 116*b* at one side. Thus, in accordance with the pivoting of the main drive arm 98, the throttle drive cam member 99 descends and pushes out the throttle operation cable 46. The displacement amount of the throttle operation cable 46 is detected by the accelerator position sensor 44. The engine ECU 14 accordingly sets the throttle opening degree to a value greater than the first opening degree (idling opening degree; fully closed opening degree). More specifically, the throttle opening degree is set to increase in conformance to the displacement amount of the throttle operation cable 46, that is, in conformance to the operation amount of the lever 43 (see FIG. 10).

When the lever 43 is operated from the neutral position NN (FIG. 13B) to the reverse drive starting position R, the main gear member 96 pivots, and as shown in FIG. 13F, the click member 107 moves out of the recessed portion 106N and fits into the recessed portion 106R. The rotation of the main gear member 96 is transmitted to the gate drive gear member 97 by the drive teeth portion 105 and the driven teeth portion 111 and causes the gate drive gear member 97 to pivot. The gate drive arm 113 thus pivots and pushes out the gate operation cable 49. The reverse gate 28 accordingly moves toward the fully closed position (see FIG. 11A) and reaches the fully closed position when the click member 107 fits into the recessed portion 106R (see FIG. 10). At the reverse drive starting position R, the drive teeth portion 105 of the main gear member 96 is shifted away from the direction of the gate drive gear member 97 and the meshing with the driven teeth portion 111 is disengaged. That is, the arcuate outer circumferential portion of the main gear member 96 opposes the concavely curved surface 112R of the gate drive gear member 97. In other words, the main gear member 96 is fitted in the concavely curved surface 112R. Pivoting of the gate drive gear member 97 is thereby restricted, and the reverse gate 28 is kept at the fully closed position (see FIG. 11A). Meanwhile, in the process in which the lever 43 moves from the neutral position NN to the reverse drive starting position R, the roller 115 of the main drive arm 98 moves through the arcuate portion 116*a* of the cam groove 116. At the reverse drive starting position R, the roller 115 of the main drive arm 98 is positioned at one end of the arcuate portion 116*a* of the cam groove 116. The throttle drive cam member 99 is thus kept at the initial position. The accelerator position sensor 44 thus detects the initial position of the throttle operation cable 46. The engine ECU 14 accordingly keeps the throttle opening degree at the first opening degree (idling opening degree; fully closed opening degree) (see FIG. 10).

When the lever 43 is operated further from the reverse drive starting position R toward the maximum output reverse drive position WR, the main gear member 96 pivots further as shown in FIG. 13G. The arcuate outer circumferential portion of the main gear member 96 moves while sliding along the concavely curved surface 112R of the gate drive gear member 97. The gate drive gear member 97 thus does not pivot, and the reverse gate 28 is thus kept at the fully closed position (see FIG. 10 and FIG. 11A). Meanwhile, the roller 115 of the main drive arm 98 departs from the arcuate portion 116*a* of the cam groove 116 and moves through the rectilinear portion 116*c* at one side. Thus, in accordance with the pivoting of the main drive arm 98, the throttle drive cam member 99 descends and pushes out the throttle operation cable 46. The displacement amount of the throttle operation cable 46 is detected by the accelerator position sensor 44. The engine ECU 14 accordingly sets the throttle opening degree to a value greater than the first opening degree (idling opening degree; fully closed opening degree). More specifically, the throttle opening degree is set to increase in conformance to the displacement amount of the throttle operation cable 46, that is, in conformance to the operation amount of the lever 43 (see FIG. 10).

The reverse gate 28 can be moved and the throttle opening degree can be changed thus in accordance with the operation of the lever 43. The pivoting of the main gear member 96 is restricted by the clicking member 107 fitting into the recessed portion 106N, 106F, and 106R, and the reverse gate 28 can thereby be kept at the first partially closed position, the second partially closed position, and the fully closed position. Also, by the main gear member 96 fitting into the concavely curved surfaces 112R and 112F of the gate drive gear member 97, the reverse gate 28 can be kept at the fully closed position and the fully opened position, respectively.

Figure 14:
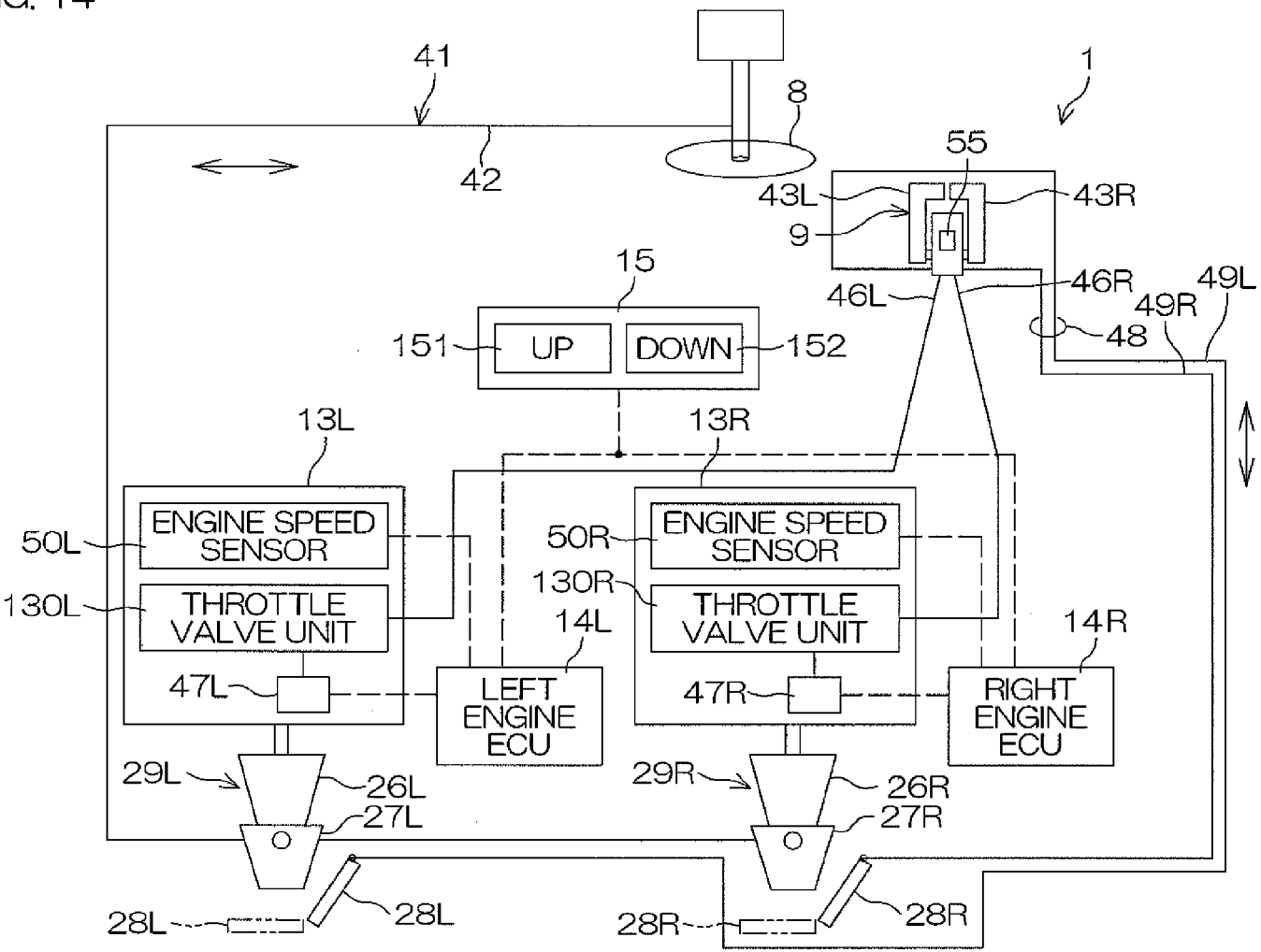
FIG. 14 is a conceptual diagram schematically showing an arrangement related to changing of a heading direction and control of output of a water jet propulsion watercraft according to a second preferred embodiment of the present invention.

FIG. 14 is a conceptual diagram schematically showing an arrangement related to changing of a heading direction and control of output of a water jet propulsion watercraft according to a second preferred embodiment of the present invention. In FIG. 14, portions corresponding to the respective portions shown in FIG. 8 are indicated by the same reference symbols. In the first preferred embodiment described above, a so-called electronically controlled throttle system is preferably used, for example. That is, the lever operations of the remote control unit 9 are detected by the accelerator position sensors 44R and 44L and the throttle actuators 45R and 45L are controlled according to the detection results. In contrast, with the second preferred embodiment, an operation force of the throttle operation cable 46 that is lead out from the remote control unit 9 preferably is mechanically transmitted respectively to throttle valve units 130R and 130L of the engines 13R and 13L. In this case, the change of throttle opening degree with respect to the operation of the lever 43 is, for example, in accordance with the characteristic line L1 of FIG. 10.

Figure 15:
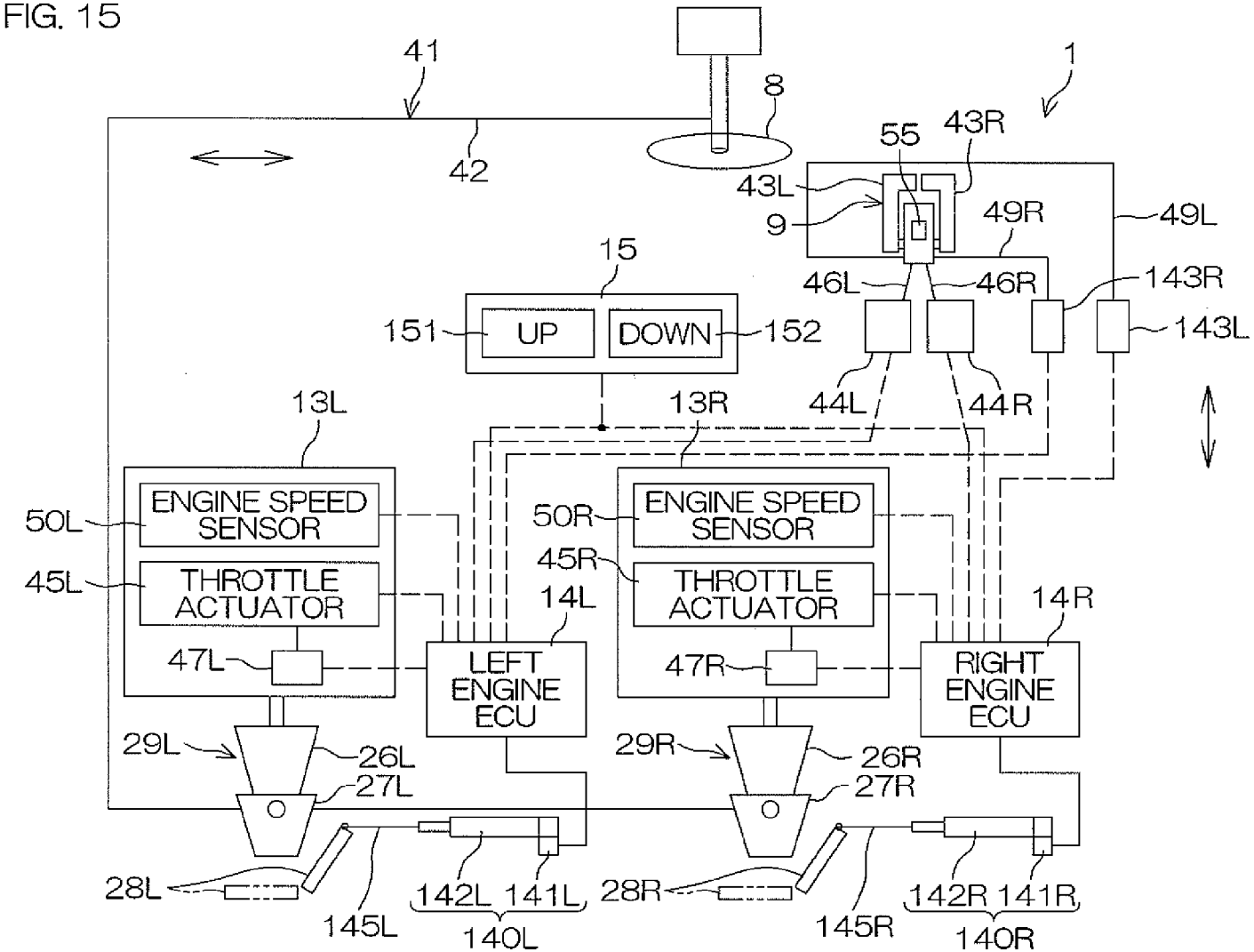
FIG. 15 is a conceptual diagram schematically showing an arrangement related to changing of a heading direction and control of output of a water jet propulsion watercraft according to a third preferred embodiment of the present invention.

FIG. 15 is a conceptual diagram schematically showing an arrangement related to changing of a heading direction and control of output of a water jet propulsion watercraft according to a third preferred embodiment of the present invention. In FIG. 15, portions corresponding to the respective portions shown in FIG. 8 are indicated by the same reference symbols. In the first preferred embodiment described above, operation forces of the gate operation cables 49R and 49L lead out from the remote control unit 9 are mechanically transmitted to the reverse gate 28. In contrast, the third preferred embodiment includes gate actuators 140R and 140L for moving the reverse gates 28. This preferred embodiment further includes position sensors 143R and 143L (lever position detecting units) arranged to detect the displacements of the gate operation cables 49R and 49L that are lead out from the remote control unit 9. Output signals of the position sensors 143R and 143L are input into the engine ECUs 14R and 14L. The position sensors 143R and 143L may include potentiometers.

The gate actuators 140R and 140L are arranged to push and pull operation cables 145R and 145L respectively connected to the reverse gates 28R and 28L. The gate actuators 140R and 140L include electric motors 141R and 141L as drive sources and drive force conversion mechanisms 142R and 142L that convert rotational forces of the electric motors 141R and 141L to push/pull operation forces of the operation cables 145R and 145L. The driving force conversion mechanisms 142R and 142L may include ball screw mechanisms or may include hydraulic cylinders. For example, the operation cables 145R and 145L can be pushed and pulled by oil pumps of hydraulic cylinders being driven by the electric motors 141R and 141L.

As in the arrangement of FIG. 8, the engine ECUs 14R and 14L control the driving of the throttle actuators 45R and 45L based on the output signals of the accelerator position sensors 44R and 44L. In addition, the engine ECUs 14R and 14L also control the driving of the gate actuators 140R and 140L based on the output signals of the position sensors 143R and 143L. That is, each of the engine ECUs 14R and 14L has a function of an actuator control unit.

Figure 16:
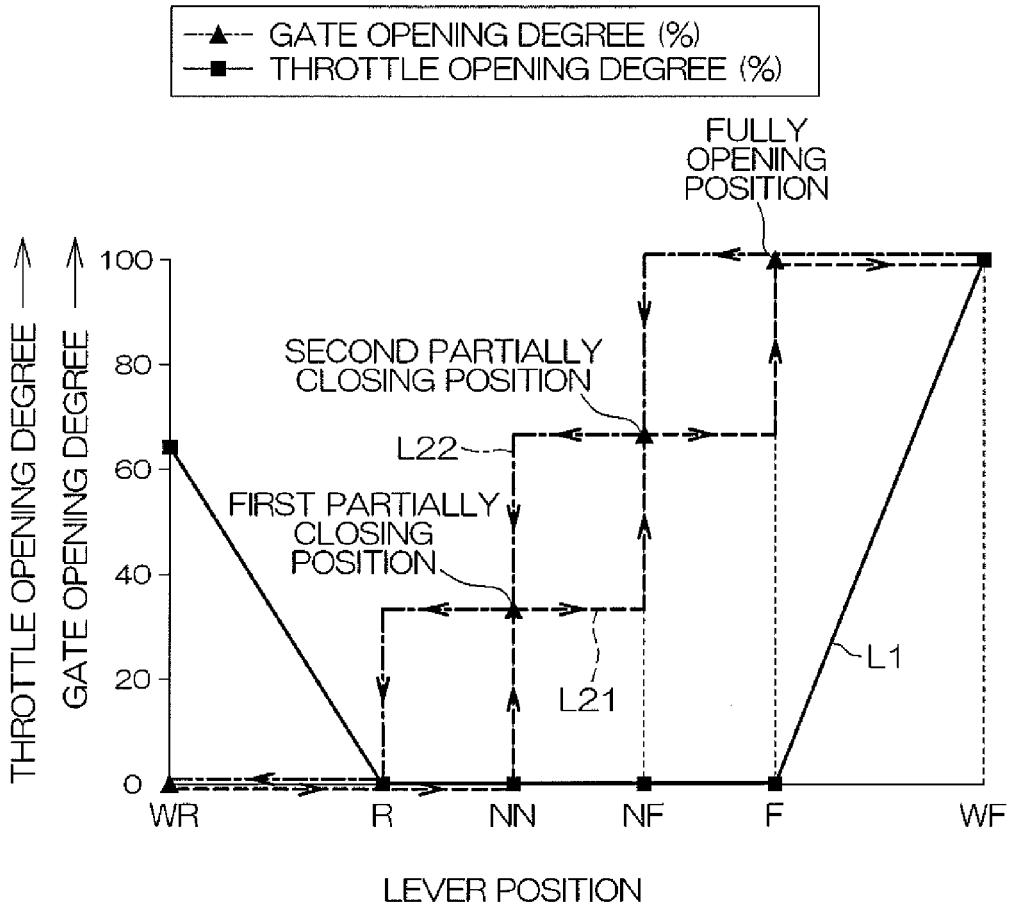
FIG. 16 is a diagram of control characteristics of the throttle opening degree and the gate opening degree in the third preferred embodiment of the present invention.

FIG. 16 is a control characteristics diagram for explaining the throttle opening degree control and the reverse gate 28 position control by the engine ECU 14 in the third preferred embodiment. The control characteristics of the throttle opening degree (characteristic line L1) are the same as that of the arrangement of FIG. 8.

When the lever 43 is operated in the direction from the maximum output reverse drive position WR toward the maximum output forward drive position WF, the engine ECU 14 controls the gate actuators 140R and 140L (hereinafter referred to collectively as the "gate actuator 140") in accordance with a characteristic line L21. That is, from the maximum output reverse drive position WR to immediately before reaching of the neutral position NN, the gate actuator 140 is controlled to keep the reverse gate 28 at the fully closed position. When the lever 43 reaches the neutral position NN, the gate actuator 140 is controlled to move the reverse gate 28 to the first partially closed position. In the lever position range from the neutral position NN to immediately before reaching of the forward drive starting position NF, the gate actuator 140 is controlled to keep the reverse gate 28 at the first partially closed position. When the lever 43 reaches the forward drive starting position NF, the gate actuator 140 is controlled to move the reverse gate 28 to the second partially closed position. In the lever position range from the forward drive starting position NF to immediately before reaching of the gate fully opened position F, the gate actuator 140 is controlled to keep the reverse gate 28 at the second partially closed position. When the lever 43 reaches the fully opened position F, the gate actuator 140 is controlled to move the reverse gate 28 to the fully opened position. In the lever position range from the gate fully opened position F to the maximum output forward drive position WF, the gate actuator 140 is controlled to keep the reverse gate 28 at the fully opened position.

On the other hand, when the lever 43 is operated in the direction from the maximum output forward drive position WF toward the maximum output reverse drive position WR, the engine ECU 14 controls the gate actuator 140 in accordance with a characteristic line L22. That is, from the maximum output forward drive position WF to immediately before reaching of the forward drive starting position NF, the gate actuator 140 is controlled to keep the reverse gate 28 at the fully opened position. When the lever 43 reaches the forward drive starting position NF, the gate actuator 140 is controlled to move the reverse gate 28 to the second partially closed position. In the lever position range from the forward drive starting position NF to immediately before reaching of the neutral position NN, the gate actuator 140 is controlled to keep the reverse gate 28 at the second partially closed position. When the lever 43 reaches the neutral position NN, the gate actuator 140 is controlled to move the reverse gate 28 to the first partially closed position. In the lever position range from the neutral position NN to immediately before reaching of the reverse drive starting position R, the gate actuator 140 is controlled to keep the reverse gate 28 at the first partially closed position. When the lever 43 reaches the reverse drive starting position R, the gate actuator 140 is controlled to move the reverse gate 28 to the fully closed position. In the lever position range from the reverse drive starting position R to the maximum output reverse drive position WR, the gate actuator 140 is controlled to keep the reverse gate 28 at the fully closed position.

It should be noted that the position control of the reverse gate 28 may be executed in accordance with the characteristic line L20 shown in FIG. 10 instead.

In the present preferred embodiment, the gate actuator 140 has a function of the gate position keeping unit that keeps the position of the reverse gate 28.

Figure 17:
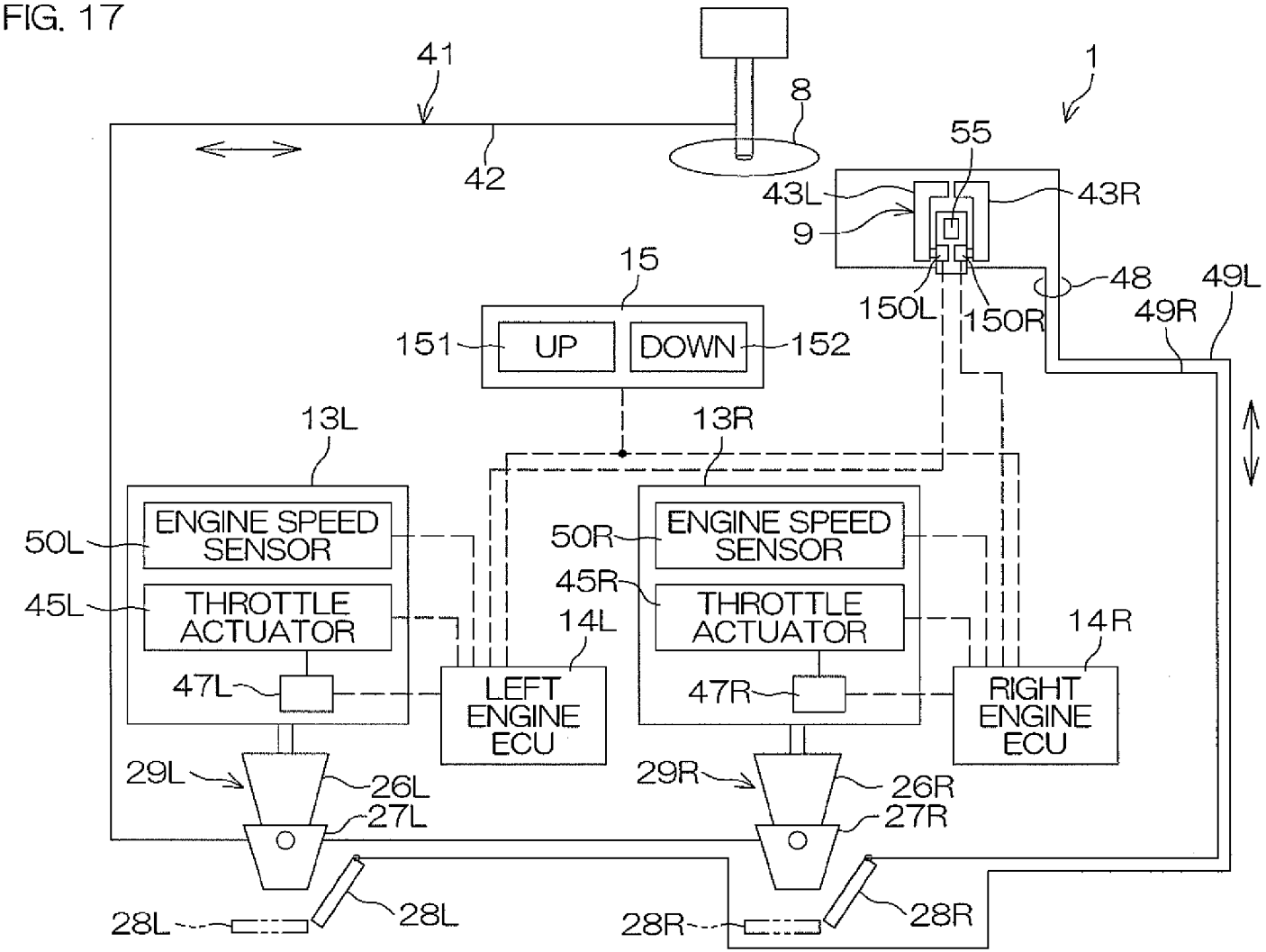
FIG. 17 is a conceptual diagram schematically showing an arrangement related to changing of a heading direction and control of output of a water jet propulsion watercraft according to a fourth preferred embodiment of the present invention.

FIG. 17 is a conceptual diagram schematically showing an arrangement related to changing of a heading direction and control of output of a water jet propulsion watercraft according to a fourth preferred embodiment of the present invention. In FIG. 17, portions corresponding to the respective portions shown in FIG. 8 are indicated by the same reference symbols. In the arrangement shown in FIG. 8, the displacement of the throttle operation cable 46 lead out from the remote control unit 9 is preferably detected by the accelerator position sensor 44. In contrast, the fourth preferred embodiment preferably includes accelerator position sensors 150R and 150L that directly detect the operation positions of the levers 43R and 43L. Output signals of the accelerator position sensors 150R and 150L thus vary in a continuous manner (for example, linearly) in the range from the maximum output reverse drive position WR to the maximum output forward drive position WF. The output signals of the accelerator position sensors 150R and 150L are input into the engine ECUs 14R and 14L, respectively. The engine ECUs 14R and 14L are arranged to control the throttle actuators 45R and 45L based on the output signals of the accelerator position sensors 150R and 150L.

The accelerator position sensors 150R and 150L (referred to as the "accelerator position sensor 150" when referred to collectively) may be incorporated in the remote control unit 9. More specifically, each of the accelerator position sensors 150R and 150L may detect a pivoting angle of the drive axis 95 of the remote control unit 9. The accelerator position sensors 150R and 150L may include potentiometers.

Figure 18:
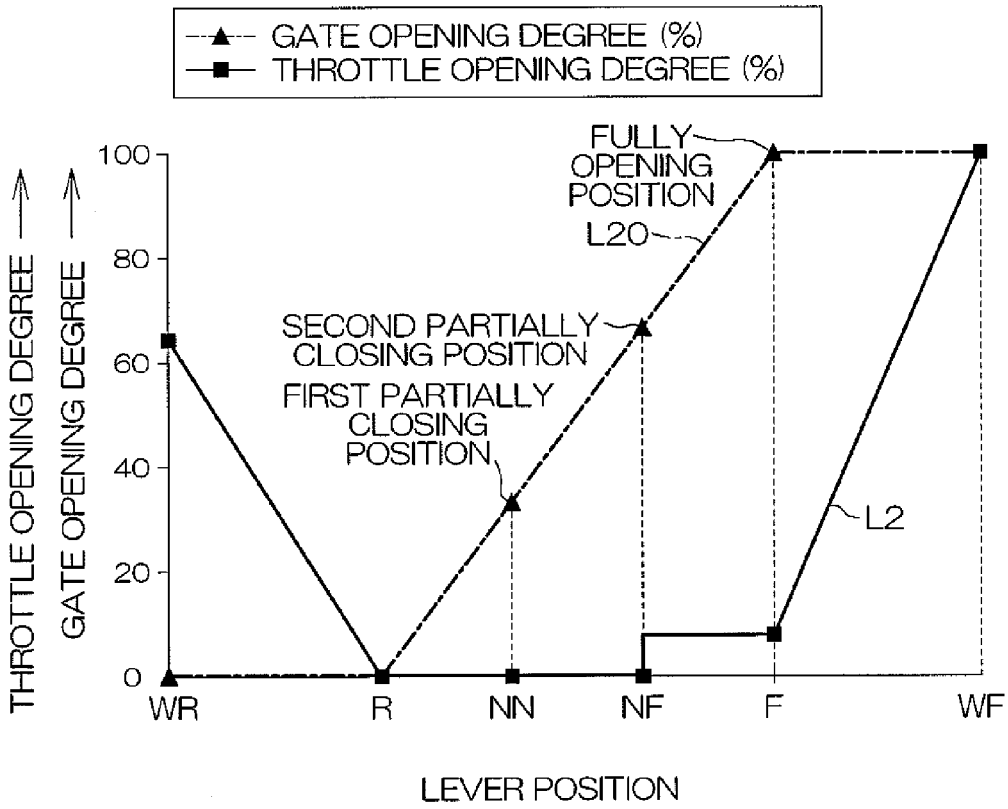
FIG. 18 is a diagram of control characteristics of the throttle opening degree and the gate opening degree in the fourth preferred embodiment of the present invention.

FIG. 18 is a control characteristics diagram for explaining the throttle opening degree control and the reverse gate 28 position control by the engine ECU 14 in the fourth preferred embodiment. The characteristics related to the reverse gate 28 position control (characteristic line L20) are the same as those of the arrangement of FIG. 8.

The throttle opening degree is controlled in accordance with a characteristic line L2. That is, at lever positions from the reverse drive starting position R to the front drive starting position NF, the throttle opening degree is kept at a predetermined first opening degree (for example, 0%; fully closed; idling opening degree). At lever positions from the forward drive starting position NF to the gate fully opened position F, the throttle opening degree is kept at a predetermined second opening degree (for example, approximately 5%). The second opening degree is greater than the first opening degree. In the range from the gate fully opened position F to the maximum output forward drive position WF, the throttle opening degree is set to increase in conformance to the displacement amount (operation amount) of the lever 43 from the gate fully opened position F. Further, when the lever 43 is positioned at the maximum output forward drive position WF, the throttle opening degree is set to an upper limit value (100%, fully open). Also, in the range from the reverse drive starting position R to the maximum output reverse drive position WR, the throttle opening degree is set to increase in conformance to the displacement amount (operation amount) of the lever 43 from the reverse drive starting position R. When the lever 43 is positioned at the maximum output reverse drive position WR, the throttle opening degree is set to a predetermined reverse drive upper limit value (for example, approximately 65%).

As can be understood from the experimental results shown in FIG. 12, when the reverse gate 28 is positioned at the second partially closed position, a better maneuvering performance can be realized the higher the engine speed. Thus, in the present preferred embodiment, the throttle opening degree is set to the second opening degree that is higher than the first opening degree to increase the engine output in the range from the forward drive starting position NF to the gate fully opened position F.

Although four preferred embodiments of the present invention have been described above, the present invention can be put into practice in yet many other modes. For example, arrangements may be made to make the lever operations of the remote control unit 9 be transmitted mechanically to the throttle valve unit of the engine 13 and be transmitted mechanically to the reverse gate 28.

The arrangements of FIG. 14 and FIG. 17 can be modified in accordance with the arrangement of FIG. 15 so that the position control of the reverse gate 2 is performed by the gate actuator. In particular, when the arrangement of FIG. 17 is provided with the gate actuator, the control of the gate actuator can be performed using the output signal of the accelerator position sensor 150. This is so because the accelerator position sensor 150 directly detects the position of the lever 43. In this case, the accelerator position sensor 150 can be used in common for throttle opening control and reverse gate position control. In this case, the accelerator position sensor 150 has the function of the lever position detecting unit for control of the gate actuator.

Also, although with each of the preferred embodiments described above, a marine vessel that includes two jet propulsion machines has been described as an example, the marine vessel may include one or three or more jet propulsion machines instead.

While preferred embodiments of the present invention have been described above, it is to be understood that variations and modifications will be apparent to those skilled in the art without departing the scope of the present invention. The scope of the present invention, therefore, is to be determined solely by the following claims.

The present application corresponds to Japanese Patent Application No. 2010-165094 filed in the Japan Patent Office on Jul. 22, 2010, and the entire disclosure of the application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine vessel propulsion device comprising:

an engine including a throttle valve arranged to open and close an air intake passage;

a jet propulsion unit driven by the engine, the jet propulsion unit including a jet port arranged to jet water to a rear of a hull, and to change a direction of the water jetted from the jet port to right and left;

a reverse gate arranged to change in opening degree between a fully closed position of covering an entirety of the jet port when the jet port is viewed from a jetting direction of the jet propulsion unit and a fully opened position of not covering the jet port at all, and arranged so that at the fully closed position the water jetted from the jet port is guided toward a front of the hull;

a steering device arranged to be operated by an operator to change the direction of the water jetted by the jet propulsion unit to the right and the left;

a lever arranged to be operated by the operator to set an opening degree of the throttle valve of the engine and the opening degree of the reverse gate, and arranged to be moved in the order of a maximum output forward drive position, to a gate fully opened position, to a forward drive starting position, to a neutral position, to a reverse drive starting position, and to a maximum output reverse drive position;

a lever position keeping unit arranged to keep the lever at the forward drive starting position, the neutral position, and the reverse drive starting position, respectively;

a throttle opening degree operating unit that increases the opening degree of the throttle valve in conformance to an operation amount of the lever from the gate fully opened position when the lever is between the gate fully opened position and the maximum output forward drive position, increases the opening degree of the throttle valve in conformance to the operation amount of the lever from the reverse drive starting position when the lever is between the reverse drive starting position and the maximum output reverse drive position, fixes the opening degree of the throttle valve at a predetermined first opening degree when the lever is between the reverse drive starting position and the forward drive starting position, and sets the opening degree to no less than the first opening degree when the lever is between the forward drive starting position and the gate fully opened position; and a reverse gate keeping unit including a control unit that keeps the reverse gate at the fully opened position when the lever is positioned in a range from the gate fully opened position to the maximum output forward drive position, keeps the reverse gate at the fully closed position when the lever is positioned in a range from the reverse drive starting position to the maximum output reverse drive position, keeps the reverse gate at a first partially closed position of only partially covering the jet port when the lever is positioned at the neutral position, and keeps the reverse gate at a second partially closed position of only partially covering the jet port and being closer to the fully opened position than the first partially closed position when the lever is positioned at the forward drive starting position; wherein the throttle opening degree operating unit controls the throttle valve to be set at the first opening degree when the lever is positioned in a range from the forward drive starting position to the gate fully opened position.

2. A marine vessel propulsion device comprising:

an engine including a throttle valve arranged to open and close an air intake passage;

a jet propulsion unit driven by the engine, the jet propulsion unit including a jet port arranged to jet water to a rear of a hull, and to change a direction of the water jetted from the jet port to right and left;

a reverse gate arranged to change in opening degree between a fully closed position of covering an entirety of the jet port when the jet port is viewed from a jetting direction of the jet propulsion unit and a fully opened position of not covering the jet port at all, and arranged so that at the fully closed position the water jetted from the jet port is guided toward a front of the hull;

a steering device arranged to be operated by an operator to change the direction of the water jetted by the jet propulsion unit to the right and the left;

a lever arranged to be operated by the operator to set an opening degree of the throttle valve of the engine and the opening degree of the reverse gate, and arranged to be moved in the order of a maximum output forward drive position, to a gate fully opened position, to a forward drive starting position, to a neutral position, to a reverse drive starting position, and to a maximum output reverse drive position;

a lever position keeping unit arranged to keep the lever at the forward drive starting position, the neutral position, and the reverse drive starting position, respectively;

a throttle opening degree operating unit that increases the opening degree of the throttle valve in conformance to an operation amount of the lever from the gate fully opened position when the lever is between the gate fully opened position and the maximum output forward drive position, increases the opening degree of the throttle valve in conformance to the operation amount of the lever from the reverse drive starting position when the lever is between the reverse drive starting position and the maximum output reverse drive position, fixes the opening degree of the throttle valve at a predetermined first opening degree when the lever is between the reverse drive starting position and the forward drive starting position, and sets the opening degree to no less than the first opening degree when the lever is between the forward drive starting position and the gate fully opened position; and a reverse gate keeping unit including a control unit that keeps the reverse gate at the fully opened position when the lever is positioned in a range from the gate fully opened position to the maximum output forward drive position, keeps the reverse gate at the fully closed position when the lever is positioned in a range from the reverse drive starting position to the maximum output reverse drive position, keeps the reverse gate at a first partially closed position of only partially covering the jet port when the lever is positioned at the neutral position, and keeps the reverse gate at a second partially closed position of only partially covering the jet port and being closer to the fully opened position than the first partially closed position when the lever is positioned at the forward drive starting position; wherein the throttle opening degree operating unit keeps the throttle valve at a predetermined second opening degree, which is greater than the first opening degree, when the lever is positioned in a range from the forward drive starting position to the gate fully opened position.

3. The marine vessel propulsion device according to claim 1, wherein the throttle opening degree operating unit includes a first opening degree changing unit that enables changing of the first opening degree by the operator.

4. The marine vessel propulsion device according to claim 1, further comprising:

a lever position detecting unit arranged to detect the position of the lever; and an actuator arranged to actuate the reverse gate; wherein the control unit controls the actuator in accordance with the lever position detected by the lever position detecting unit.

5. A marine vessel comprising:

a hull; and the marine vessel propulsion device according to claim 1 installed on the hull.

6. A marine vessel propulsion device comprising:

an engine including a throttle valve arranged to open and close an air intake passage;

a jet propulsion unit driven by the engine, the jet propulsion unit including a jet port arranged to jet water to a rear of a hull, and to change a direction of the water jetted from the jet port to right and left;

a reverse gate arranged to change in opening degree between a fully closed position of covering an entirety of the jet port when the jet port is viewed from a jetting direction of the jet propulsion unit and a fully opened position of not covering the jet port at all, and arranged so that at the fully closed position the water jetted from the jet port is guided toward a front of the hull;

a steering device arranged to be operated by an operator to change the direction of the water jetted by the jet propulsion unit to the right and the left;

a lever arranged to be operated by the operator to set an opening degree of the throttle valve of the engine and the opening degree of the reverse gate, and arranged to be moved in the order of a maximum output forward drive position, to a gate fully opened position, to a forward drive starting position, to a neutral position, to a reverse drive starting position, and to a maximum output reverse drive position;

a lever position keeping unit arranged to keep the lever at the forward drive starting position, the neutral position, and the reverse drive starting position, respectively;

a throttle opening degree operating unit that increases the opening degree of the throttle valve in conformance to an operation amount of the lever from the gate fully opened position when the lever is between the gate fully opened position and the maximum output forward drive position, increases the opening degree of the throttle valve in conformance to the operation amount of the lever from the reverse drive starting position when the lever is between the reverse drive starting position and the maximum output reverse drive position, fixes the opening degree of the throttle valve at a predetermined first opening degree when the lever is between the reverse drive starting position and the forward drive starting position, and sets the opening degree to no less than the first opening degree when the lever is between the forward drive starting position and the gate fully opened position; and a reverse gate keeping unit including a control unit that keeps the reverse gate at the fully opened position when the lever is positioned in a range from the gate fully opened position to the maximum output forward drive position, keeps the reverse gate at the fully closed position when the lever is positioned in a range from the reverse drive starting position to the maximum output reverse drive position, keeps the reverse gate at a first partially closed position of only partially covering the jet port when the lever is positioned at the neutral position, and keeps the reverse gate at a second partially closed position of only partially covering the jet port and being closer to the fully opened position than the first partially closed position when the lever is positioned at the forward drive starting position; wherein the control unit keeps the reverse gate at the second partially closed position when the lever is moved from the forward drive starting position to immediately before the gate fully opened position.

* * * * *